US006030068A

United States Patent [19]

Narushima

[11] Patent Number: 6,030,068

[45] Date of Patent: Feb. 29, 2000

[54] RECORDING METHOD AND RECORDING APPARATUS

[75] Inventor: Toshio Narushima, Kanagawa, Japan

[73] Assignee: Sony Corporation, Tokyo, Japan

[21] Appl. No.: 08/825,926

[22] Filed: Apr. 2, 1997

[30] Foreign Application Priority Data

Apr. 5, 1996 [JP] Japan ..... 8-110285
Apr. 26, 1996 [JP] Japan ..... 8-130951

[51] Int. Cl.[7] ..... B41J 2/05

[52] U.S. Cl. ..... 347/40

[58] Field of Search ..... 347/40, 41, 14

[56] References Cited

U.S. PATENT DOCUMENTS 4,463,359 7/1984 Ayata et al. ..... 347/56
4,614,953 9/1986 Lapeyre ..... 347/43
5,155,503 10/1992 Tasaki et al. ..... 347/14
5,351,137 9/1994 Kato et al. ..... 358/457

*Primary Examiner*—N. Le
*Assistant Examiner*—Lamson D. Nguyen
*Attorney, Agent, or Firm*—Hill & Simpson

[57] ABSTRACT

In a recording apparatus, spreading of ink droplets is avoided, and mixing of adjacent ink droplets is prevented so as to improve an image quality of a recorded image, and to increase resolution of this recorded image. In a recording apparatus for jetting ink droplets corresponding to recording data from a recording head to thereby adhere the ink droplets in a dot form onto a recorded member, there are provided: a data input unit for obtaining recording data in such a manner that no ink droplet is jetted to a specific dot existing in a preselected interval in such a region that a large number of recording dots are formed having density higher than at least predetermined density, whereas the ink droplets are jetted to dots other than said specific dot; a signal converting unit for converting this recording data into a recording head drive signal; and a drive unit for driving a recording head by modulating this converted signal. Also, while improving image qualities by employing the carrier jet type printer, the character and the image can be separately formed in the character region and the image region in response to the recording data.

12 Claims, 20 Drawing Sheets

RECORDING METHOD AND RECORDING APPARATUS

BACKGROUND OF THE INVENTION

The present invention generally relates to a recording method and a recording apparatus. More specifically, the present invention is directed to a printing method and a printer for jetting a recording fluid such as ink in a form of fluid droplets and for adhering the recording fluid on a recording member in a dot shape to execute a recording operation.

Very recently, strong needs are rapidly made of producing hard copies in color in connection with marketing of color video cameras and color computer graphics. To meet these requirements, various color hard copying recording systems have been proposed, for instance, sublimination type heat transfer systems, thermal melting transfer systems, ink jet systems, electrophotographing systems, thermal developing silver halide systems and so on. Among these recording systems, the method capable of simply outputting high quality images by way of a simple apparatus may be mainly classified into the dye diffusion thermal transfer method and the ink jet method.

In the dye diffusion thermal transfer method among these recording systems, either the ink ribbon or the sheet on which the ink layer is coated, and the transferred member are closely attached to each other under constant pressure, to which heat corresponding to the image information is applied from the heat sensitive recording head located on the ink sheet. Then, the transfer dye is thermally transferred in response to the head amount applied from the ink sheet to the receiving layer. In the ink layer, the transfer dye with high density is distributed in the proper binder resin. As the transferred member, there is a printing paper on which the dy accepting resin for accepting the transferred dy is coated.

In a so-called "thermal transfer" method where the above-described operations are repeatedly performed as to the three primary colors of the subtraction mixture color, namely the image signals solved into yellow, magenta, and cyan, the full color image having the continuous gradation can be produced. This thermal transfer system is known as the excellent recording technique capable of producing the high grade images equivalent to the silver halide color photographic images in a compact and maintenance free characteristic.

FIG. 1 is a front view for schematically showing a major portion of this thermal transfer type printer.

In FIG. 1, a heat sensitive recording head (will be referred to as a "thermal head" hereinafter) 100 is located opposite to a platen roller 101. An ink sheet 102 made of an ink layer 102*a* on a base film 102*b*, and a recording paper (recorded member) 103 provided with a type accepting resin layer 103*a* on a paper 103*b* are sandwiched between the thermal head 100 and the platen roller 101. These members are traveled while being depressed against the thermal head 100 by the rotating platen roller 101.

Then, the ink (transfer dye) contained in the ink layer 102*a* selectively heated by the thermal head 100 is transferred in a dot form to the dye accepting resin layer 103*a* of the recording paper 103 to thereby execute the thermal transfer recording operation. As such a thermal transfer recording operation, the serial system and the line system are employed. That is, in the serial system, the thermal head is scanned along the direction perpendicular to the travel direction of the recording paper 103. In the line system, one thermal head is fixedly arranged along the direction perpendicular to the travel direction of the recording paper. This non-impact recording method is widely spread in view of such a fact that the recording noise is extremely low during the recording operation.

Different from this thermal transfer system, a so-termed "ink jet recording method" is known in the field. This ink jet recording system is capable of performing the highspeed recording operation. Moreover, the recording operation can be done by employing a so-called "normal paper" without requiring a specific fixing process. Therefore, this ink jet recording system will gradually constitute the major recording system capable of reproducing the images such as computer graphics as hard copies.

As described in Japanese Patent Publication No. 61-59911 published in 1986 and Japanese Patent Publication No. 5-217 published in 1993, the above-explained ink jet type printer is such that in response to image information, recording fluid droplets are jetted from nozzles provided in a recording heads by way of the electrostatic absorbing method, the electro-mechanical converting method (piezoelectric element method), and the thermal method (bubble jet method), and then these recording fluid droplets are adhered onto recording materials for recording operation.

As a result, since substantial no waste material is produced and running cost is low, this ink jet type printer becomes popular.

On the other hand, in a so-called "on-demand type ink jet type printer apparatus" (will be simply referred to as an "ink jet printer" hereinafter), ink droplets are jetted from nozzles in response to recording signals so as to record the content of this recording signal on a recording member such as a paper and a film. Since this ink jet printer can be made compact and low cost, the ink jet printers are rapidly spread in recent years.

In general, for example, piezoelectric elements and heating elements are employed so as to jet ink droplets in such an ink jet printer. In a piezoelectric element type ink jet printer, the piezoelectric element is deformed to thereby give pressure to the ink, and thus the ink droplets are jetted from the nozzles.

FIG. 2A to FIG. 2C illustrate one conventional ink jet printer (e.g., on-demand type ink jet printer).

First, a structure of a printing head shown in FIG. 2A is constructed of a cylindrical casing 111 made of glass, and a cylindrical electrostrictive vibrating element (piezoelectric element) 112 provided on an outer side surface of this casing 111. On both edge portions of this casing 111, there are provided an ink supply port 114 for filling ink 110 into an ink chamber 113 of the casing 111, and a nozzle 116 and also an orifice portion 117, which may jet the ink as ink fluid droplets 115.

Then, when a predetermined voltage is applied from a voltage generator 118 to the electrostrictive vibrating element 112, this electrostrictive vibrating element 112 is deformed which may cause the capacity of the ink chamber 113 within the casing 111 to be changed. In response to this capacity change, the inner pressure of the ink chamber 113 is increased, so that the ink droplets 115 are jetted from the nozzle 116.

As a consequence, when the voltage generator 118 is driven in response to arbitrary print information, the ink droplets 115 can be jetted from the nozzle 116 based on this print information. Then, the jetted ink droplets 115 are adhered onto a recording paper (not shown in detail) functioning as a recording medium to execute the printing operation.

Also, FIG. 2B represents an example of a printing head with employment of a plane-shaped electrostrictive vibrating element. In this printing head, one surface of a casing 121 made of a proper material is constituted as a vibrating plate 122, and an electrostrictive vibrating element 123 is adhered on the outer surface of this vibrating plate 122, so that a so-called "bimorph plate" is fabricated. Furthermore, on both edge portions of this casing 121 there are provided an ink supply port 125 for filling ink 120 into an ink chamber 124 of the casing 121, and a nozzle 127 and also an orifice portion 128, which may jet the ink as ink fluid droplets 126.

Then, when a predetermined voltage is applied from a voltage generator 129 to the electrostrictive vibrating element 123, this electrostrictive vibrating element 123 is deformed which may cause the capacity of the ink chamber 124 within the casing 121 to be changed. In response to this capacity change, the inner pressure of the ink chamber 124 is increased, so that the ink droplets 126 are jetted from the nozzle 127.

As a consequence, when the voltage generator 129 is driven in response to arbitrary print information, the ink droplets 126 can be jetted from the nozzle 127 based on this print information. Then, the jetted ink droplets 126 are adhered onto a recording paper (not shown in detail) functioning as a recording medium to execute the printing operation.

Further, FIG. 2C indicates an example of a so-termed "Stemme (two-chamber) type printing head". In this printing head, one surface of a casing 131 made of an arbitrary material is made as a vibrating plate 132, and an electrostrictive vibrating element 133 is adhered onto an outer surface of this vibrating plate 132, which may constitute a so-called "bimorph plate". A pressure chamber 134 is formed in the casing 131, and an ink supply path 135 is provided, while being communicated with this pressure chamber 134.

Also, an ink supply port 136 is formed which may fill ink 130 into the ink supply path 135. A nozzle 138 and an orifice portion 139, which may jet the ink as ink fluid droplets 137, are provided at a position opposite to a communication portion between this ink supply path 135 and the pressure chamber 134.

Then, when a predetermined voltage is applied from a voltage generator 140 to the electrostrictive vibrating element 133, this electrostrictive vibrating element 133 is deformed which may cause the capacity of the ink chamber 134 within the casing 13 to be changed. In response to this capacity change, the inner pressure of the ink chamber 134 is increased, so that the ink droplets 137 are jetted from the nozzle 138.

As a consequence, when the voltage generator 140 is driven in response to arbitrary print information, the ink droplets 137 can be jetted from the nozzle 138 based on this print information. Then, the jetted ink droplets 137 are adhered onto a recording paper (not shown in detail) functioning as a recording medium to execute the printing operation.

On the other hand, FIGS. 3A, 3B, 3C and 3D represent other examples of printing heads used in the above-described ink jet printer (for instance, on-demand type ink jet printer), in which ink is jetted by using, for example, a heating element.

In accordance with the structure of this printing head, a heating element 152 is provided inside a nozzle 151, and power is supplied to this heating element 152 so as to instantaneously vaporize ink 150 inside the nozzle 151. Then, in response to pressure of bubbles produced by this ink vaporization, ink droplets 157 are jetted from a tip portion 154.

That is, in FIG. 3A, when power is supplied to the heating element 152, the ink 150 in contact with the heating element 152 is heated to be vaporized, so that a plurality of small bubbles 156 are produced. These plural bubbles 156 are combined with each other to become a single large bubble 157 (see FIG. 3B). Thus, the ink 150 present in the nozzle 151 is extruded from the tip portion 154 in response to pressure of this large bubble 157, as shown in FIG. 3C.

Then, when the supply of power to the heating element 152 is interrupted under such a condition as shown in FIG. 3C, the bubble 157 is rapidly reduced, so that the pressure in the nozzle 151 is lowered. As a result, the ink extruded from the tip portion 154 is separated from the ink 150 stored in the nozzle 151, and as shown in FIG. 3D, the separated ink is jetted as ink droplets 157.

As a consequence, when the heating element 152 is driven based on arbitrary print information, the ink droplets 157 can be jetted from the nozzle 151 in response to this print information. Then, the ink droplets 157 are adhered on a recording paper (not shown) functioning as a recording medium.

On the other hand, when each of the respective printing heads is used to record a desirable image on a recording paper, as schematically shown in FIG. 4, for example, while the serial type printing head 16 is scanned along the main scanning direction with respect to the recording paper 180, the ink is jetted in response to the image information so as to be adhered as the pixel 181 in the dot shape. It should be understood that this recording operation is carried out based on two values, i.e., jetting of the ink droplets, and non-jetting of the ink droplets.

In this case, when the image quality of the recorded dot (pixel) is improved by the gradation representation (half tone), there is such a case that the print information is formed in, for instance, 8 bits (=256 gradation). To the contrary, when the gradation (6 bits=64 gradation) of the intermediate gradation (half tone) printed by the printer apparatus is smaller than 256 gradation, the gradation extending method such as a so-called "multi-gradation dither method" (as one example, multi-gradation error diffusion method) is employed.

That is to say, for example, in the multi-gradation error diffusion method, as represented in FIG. 5, a level of an arbitrary pixel "A" for constituting an image is replaced from an originally printed level X (256 gradation) into an actually printed level X' (normally, 4, 6, 8, 16, 32, 64 gradation, in this case, 64 gradation). In this case, the following methods are employed. That is, the level X' to be replaced is set tot he level being nearest the level X. Alternatively absolute values of differences between plural levels realized by the level X' and the level X are replaced as probabilities. In the latter method, there are possibilities that the level X' is replaced by all of the realizable levels.

Moreover, an error portion "$\epsilon$" between the level X and the level X' is distributed to pixels around the pixel "A" so as to be added. As indicated in FIG. 5, as to this distribution method, there are the following methods. In one distribution method, (7/16)$\epsilon$ is distributed to a pixel subsequent to the pixel A, (3/16)$\epsilon$ is distributed to a pixel before the next scanning line, (5/16)$\epsilon$ is distributed to a pixel just under the pixel A, and (1/16)$\epsilon$ is distributed to a pixel after the next scanning line. In another distribution method, the error portion is distributed only to an arbitrary one pixel at probability of the respective distribution rates.

It should be noted that the error portion ϵ owns codes of "±". The errors of the peripheral pixels to which the errors have been distributed are calculated as to the value, added with the distributed errors. Furthermore, when the value added with the distributed error exceeds a maximum printing level or a minimum printing level in a printable range, the value exceeding this maximum printing level or minimum level may be clipped. Otherwise, this exceeding portion is again distributed to the peripheral pixels in the above-described rate, or probability in a similar calculation manner to the above error portion "ϵ".

In this manner, the error portion ϵ of the pixel A is distributed to the peripheral pixels, so that the printing error is distributed. This is carried out over the overall input image to thereby form image data to be printed. As a result, the gradation of the image which is obtained by printing out the print information can be essentially enlarged (for example, 64 gradation is enlarged into 256 gradation). The above-described distribution rate and numeral values are merely one example, and therefore may be varied in accordance with the differences of the gradation to be converted, and ranges (number) of pixels to which the error portions are distributed.

As a consequence, for instance, since the above-described dither method is employed in the host computer, the print information of 64 gradation which can be printed by the printer apparatuses can be formed from the print information of 256 gradation (=8 bits) formed in the host computer. Then, in this case, for example, the print information of 64 gradation is expressed by, for instance, 6 bits.

In FIG. 6, there is shown such a condition that the input data (print information) shown by a broken line is converted along the X direction by way of the above-described multi-gradation error diffusion method, namely this input data having the corresponding gradation every dots along the main scanning direction of the print head.

In this case, in the image to be printed out, a total amount of the ink fluids jetted from the printing head at a certain portion is determined based on the characteristic of the ink fluids, the characteristic of the recording paper, and the printing speed. However, the ink droplets on the recording paper are spread to be mixed with each other, resulting in deteriorations of the color reproducing characteristic and of the image quality, and further of the resolution. These deteriorations are commenced at the minimum printing density.

Accordingly, in such a case that the image to be printed owns the continuous expansion higher than the minimum printing density, particularly, in the multi-gradation error diffusion method, while the ink jetted so as to form one pixel is not fixed on the recording paper, the succeeding ink is jetted to the adjoining position (otherwise, same position) immediately after the first-mentioned ink is jetted. Thus, the total ink amount is increased, so that the ink droplets are spread. Since drying of the ink droplets is delayed, the adjoining ink droplets are mixed with each other, resulting in deteriorations of the color representing characteristic, of the image quality, and of the resolution. To avoid this difficulty, expensive print-dedicated recording papers are used, and there is a limitation in the printing speed.

This problem is particularly produced when the print-dedicated recording paper is not used (namely, low-cost normal paper, and reproduced paper, i.e., general-purpose recording papers), when the environmental temperatures during the printing operation are lowered, or when the printing head is scanned in high speed. Even when the print-dedicated recording paper is employed, a similar problem may occur. Also, in a two-fluid mixing type printer, so-called "carrier jet type printer" (will be discussed later), when the extra-jetted ink is jetted on the recording paper, this extra-jetted ink may give the large adverse influences to the image quality. Therefore, there is another problem that the intermediate gradation (half tone) could not be achieved.

However, to improve image qualities of recorded dots (pixels) by way of gradation (half tone) representations in such an ink jet printer, the Applicant has proposed the novel carrier jet type printing system as disclosed in Japanese patent Application No. 7-254250 filed on Sep. 29, 1995. In this novel carrier jet type printing system, any one of the dilution fluid and the ink is quantified in accordance with the print information, and the other item is mixed in a preselected amount to produce the mixture fluid, and then this mixture fluid is used to print out a half tone. This novel two-fluid mixing type printing system will be later discussed more in detail.

SUMMARY OF THE INVENTION

While improving the image qualities by this carrier jet type printing system, the Applicant has made every effort to achieve optimum required character/image printing qualities when characters and images are formed in character regions and image regions in accordance with recording data.

The present invention has been made to solve the above-explained problems, and therefore, has an object to provide a recording method and a recording apparatus capable of effectively increasing an image quality, while suppressing mutual interference between recorded dots.

In other words, the present invention is directed to a recording method, in which when the recording operation is carried out by using a large number of dots based on recording data, in such a region that any of the plural dots are sequentially formed having density higher than a preselected density value, only the dots other than a specific dot are recorded.

According to the present invention, such a recording apparatus is provided which is comprised of a data input unit capable of obtaining recording data by which the dots other than a specific dot can be recorded when the recording operation is carried out by using a large number of dots based on recording data, in such a region that any of the plural dots are sequentially formed having density higher than a preselected density value; a signal converting unit for converting this recording data into a recording head drive signal; a drive unit for driving a recording head by modulating this converted signal; and a recording head.

It should be noted that the above-described "predetermined density" implies such minimum density. That is, when a recording material such as ink droplets is adhered in a dot shape on a recording member to execute a recording operation by way of an ink jet type recording system, the recording materials adhered on the recording member are started to be spread, and the adjoining recording materials are commenced to be mixed with each other.

In accordance with the recording method and the recording apparatus of the present invention, only the dots other than a specific dot are recorded (namely, specific dot is not recorded) in the region that a plurality of recording dots having density higher than predetermined density are formed. Accordingly, when a single pixel is formed, this recording material is adhered on a recorded member such as a recording paper, and immediately after, no recording operation is performed as a specific dot position. As a consequence, even when the recording material on the recorded member is fixed and subsequently, another recording material is adhered onto another position adjacent to the first-mentioned position (otherwise, same position) to thereby form the next pixel, these recording materials of not mutually interfere with each other.

In other words, since after one recording material has been adhered with having a space of this specific dot and then is fixed, other recording material is adhered, when the pixel density is increased, the following problem can be minimized such that for instance, the ink droplets on the recording paper are spread, and the ink droplets are mixed with each other. Thus, the color reproducing characteristic can be improved to obtain the high image quality, and also the resolution can be increased.

The above-described particular effects can be achieved even under the following cases, namely when no print-dedicated paper is used a the recorded member, when the environmental temperatures during the printing operations are lowered, and when the printing head is scanned in high speeds. As a consequence, the low-cost recording paper can be used, resulting in low-cost operation and easy operation.

Furthermore, when the half tone (intermediate gradation) is improved by using the above-described multi-gradation error diffusion method in the two-fluid mixing type printer (so-called "carrier jet type printer"), the adverse influence given to the image quality is minimized in order that the extra-jetted ink fluid is not jetted on the recording paper, and therefore, the desirable half tone can be achieved under better condition.

As a result, in particular, a recording method and a recording apparatus, which are very suitable for the above-described carrier jet type recording system, could be found out in accordance with the present invention.

That is, the present invention is related to such a recording method wherein:

when a character and an image are formed in a character region and an image region, respectively, in response to recording data, in the character region, recording data corresponding to a predetermined character is outputted, and no recording data is outputted to a non-character portion for constituting a background; and in the image region, recording data corresponding to half-tone image printing is outputted, and then a predetermined main image printing portion and a background thereof are printed out.

Also, in accordance with the present invention, the below-mentioned recording apparatus may be provided. That is, this recording apparatus is featured by comprising:

a data input unit for obtaining recording data used to execute the following recording method;

a signal converting unit for converting this recording data into a recording head drive signal;

a drive unit for modulating a recording head based on this converted drive signal so as to drive the recording head; and a recording head.

In the above-described recording method, when a character and an image are formed in a character region and an image region, respectively, in response to recording data, in the character region, recording data corresponding to a predetermined character is outputted, and no recording data is outputted to a non-character portion for constituting a background; and in the image region, recording data corresponding to half-tone image printing is outputted, and then a predetermined main image printing portion and a background thereof are printed out.

In accordance with the recording method and the recording apparatus of the present invention, the following features can be obtained:

(1). Since none of recording data is outputted to the portions other than the character within the character region (concretely speaking, none of ink droplet is jetted), the resulting contrast between the character portion and other background portions becomes maximum. Also, since there is no ink in the portions other than the character, it is possible to avoid such a problem that the ink fluids are spread. Moreover, since the transparent fluid component (dilution fluid) is not jetted at the unnecessary portion (namely, portion except for character), the total amount of the consumed transparent fluid can be minimized, so that the printing cost can be reduced.

(2). In the image region, it is required to achieve the better gradation reproducibility in the printed image. The suitable method is applied to the main image printing portion and the background thereof.

As previously described, in the recording method and the recording apparatus of the present invention, since the character region is discriminated from the image region, the optimum character printing method and also the optimum image printing method can be employed in the respective regions, so that the image qualities in the respective regions can be improved. In particular, these inventive recording method/apparatus may constitute the effective means when the above-explained two-fluid mixing type printing method is executed, but are not required in the conventional two-value ink jet printer.

Preferably, according to the recording method and the recording apparatus of the present invention, while either ink or a mixture fluid is jetted in a dot shape so as to be adhered onto a recording member based on recording data, the mixture being made by mixing the ink with an ink dilution fluid, and a character and an image are formed in a character region and an image region by way of a two-fluid mixing type printing method, In the character region, either the mixture fluid or the ink is jetted to print out the character, whereas the ink, the mixture fluid, or the ink dilution fluid is not jetted onto a non-character portion; and In the image region, the mixture fluid is jetted to print out a main image printing portion, whereas when the mixture fluid is not jetted, the dilution fluid is jetted.

In this case, when no mixture fluid is jetted in the image region, the ink dilution fluid is jetted, so that the background image can be printed out. Also, the color ink in cyan, magenta, and yellow, or the color ink in cyan, magenta, yellow, and black can be used. In particular, the dilution fluid for the cyan color may be preferably jetted.

Furthermore, a large number of dots may be recorded by way of the multi-gradation dither method capable of realizing a recording image with a better gradation characteristic.

Concretely speaking, when the recorded image by a large number of recording dots own the continuous expansion having the density larger than a preselected density in the recording method and the recording apparatus of the present invention, no printing operation is performed for the specific dots existing in a predetermined interval.

Preferably, a large number of dots are used to record desirable print information by way of the multi-gradation dither method for obtaining a recorded image with a better gradation characteristic, and then the recording data as to the specific dots are distributed to the dots located around the specific dots.

Then, when the ink droplets are adhered in the dot shape on the recording member to perform the recording operation by the ink jet type printer, as to the specific dot existing every a preselected interval, no ink droplet is jetted in such a region that a large number of recording dots are formed with the density higher than the minimum density at which the ink droplets adhered on this recording member start to be spread and the adjoining ink droplets start to be mixed with each other.

As the ink jet system, a so-called "carrier jet system" is preferably employed in which the quantified ink is mixed with the ink dilution fluid to form the recording droplets, and then these recording droplets are adhered in a dot shape onto the recording member.

BRIEF DESCRIPTION OF THE DRAWINGS

For a better understanding of the present invention, reference is made of the detailed description to be read in conjunction with the accompanying drawings, in which.

DETAILED DESCRIPTION OF THE PREFERRED EMBODIMENTS

Referring now to drawings, various embodiments of the present invention will be described.

Figure 7:
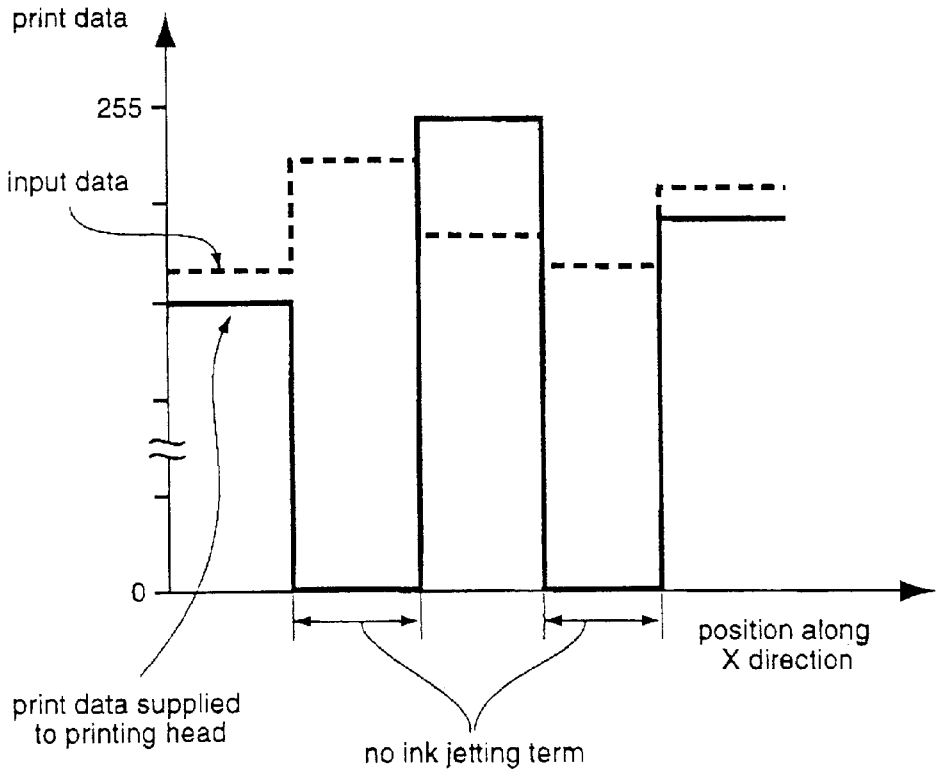
FIG. 7 is a waveform diagram for showing print data supplied to a printing head of an ink jet printer according to the present invention.
Figure 8A:
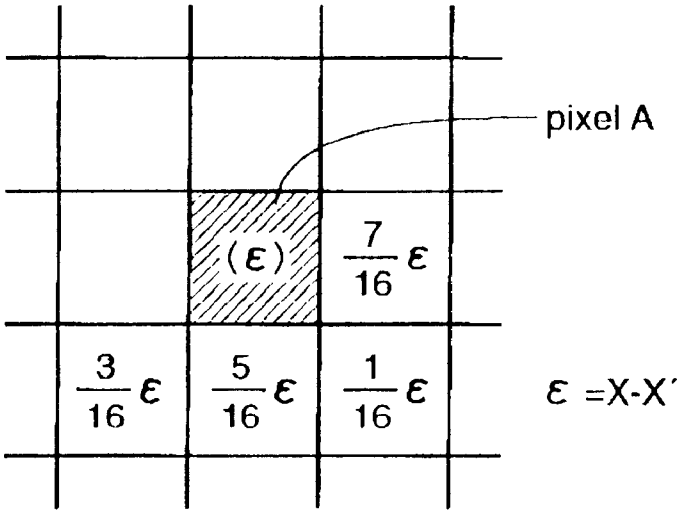
FIGS. 8A and 8B are explanatory diagrams for explaining a multi-gradation error diffusion method by the printing head of FIG. 8 during the printing operation.
Figure 8B:
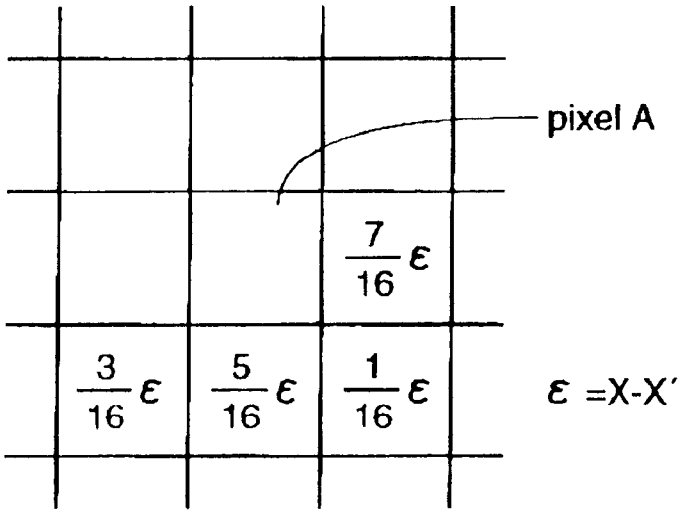

First, a description will now be briefly made of a recording method by way of an ink jet printer according to the present invention with reference to FIG. 7 and FIGS. 8A and 8B.

Figure 1:
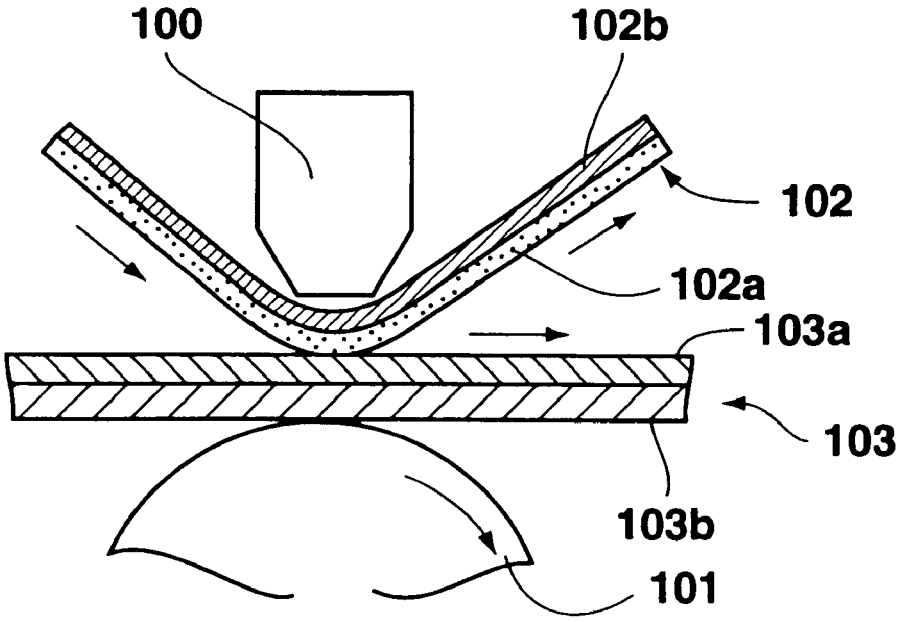
FIG. 1 (PRIOR ART)
FIG. 1 is a front sectional view for schematically showing the conventional thermal transfer type printer apparatus.
Figure 2A:
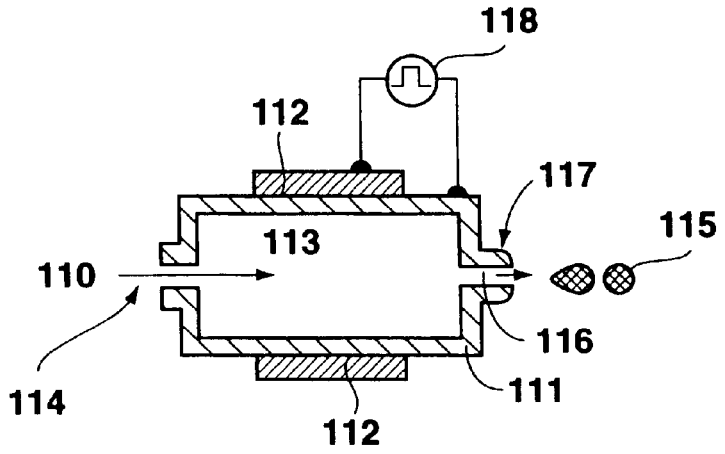
FIG. 2A (PRIOR ART)
FIGS. 2A through 2C are sectional views for schematically indicating jetting conditions by the printing heads of the various sorts of conventional ink jet printers.
Figure 2B:
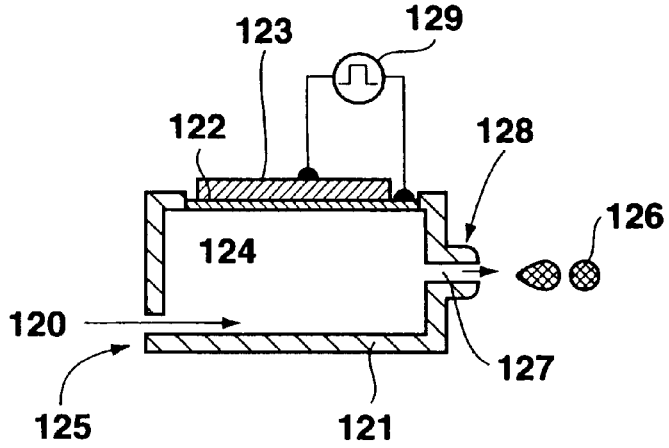
FIG. 2B (PRIOR ART)
Figure 2C:
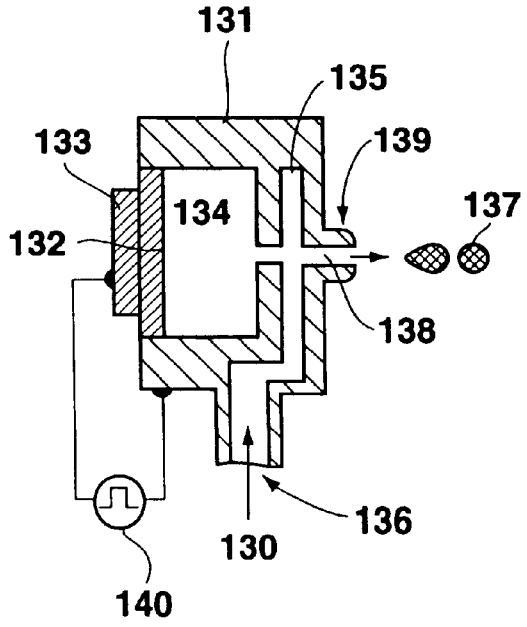
FIG. 2C (PRIOR ART)
Figure 3A:
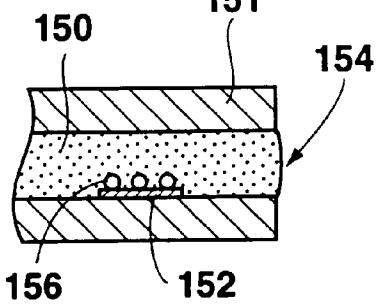
FIG. 3A (PRIOR ART)
FIGS. 3A through 3D are sectional views for schematically indicating ink jetting conditions by the printing heads of other conventional ink jet printers.
Figure 3B:
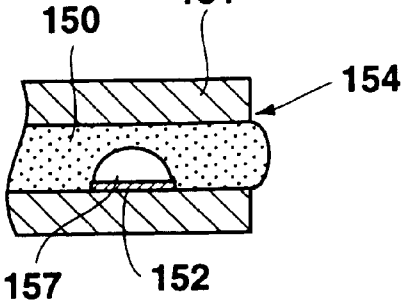
FIG. 3B (PRIOR ART)
Figure 3C:
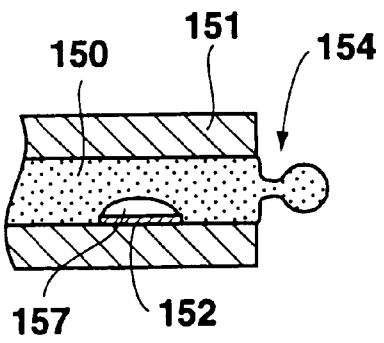
FIG. 3C (PRIOR ART)
Figure 3D:
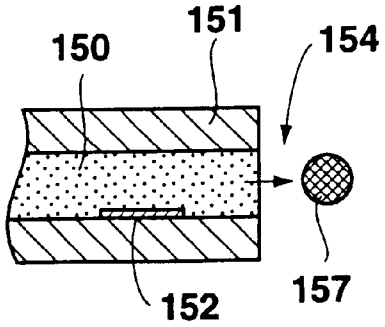
FIG. 3D (PRIOR ART)
Figure 4:
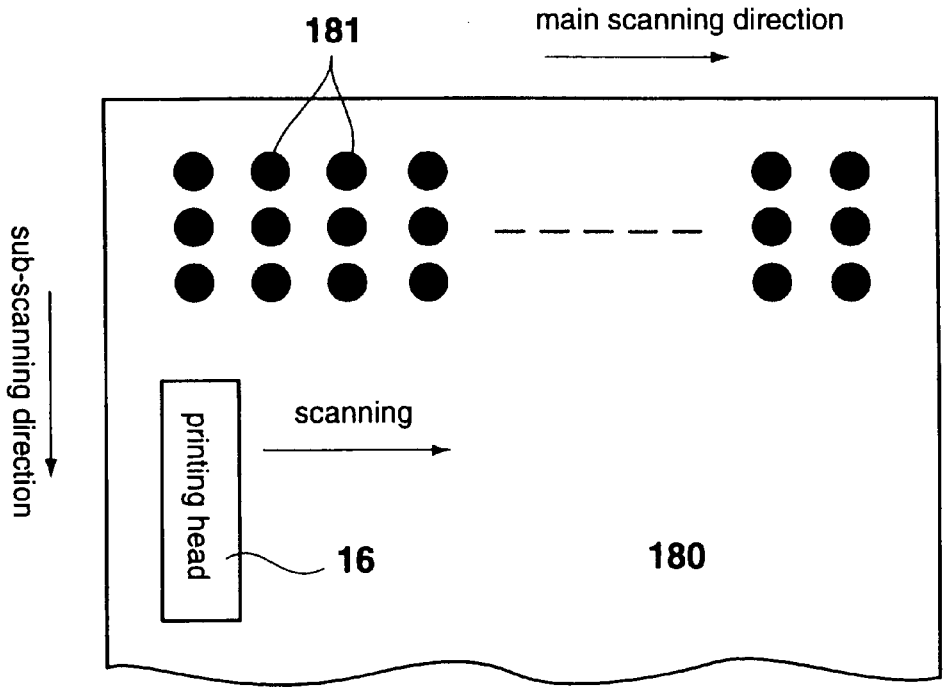
FIG. 4 (PRIOR ART)
FIG. 4 is a plan view for schematically explaining printing conditions under which the printing head of the conventional ink jet printer is used to scan.
Figure 5:
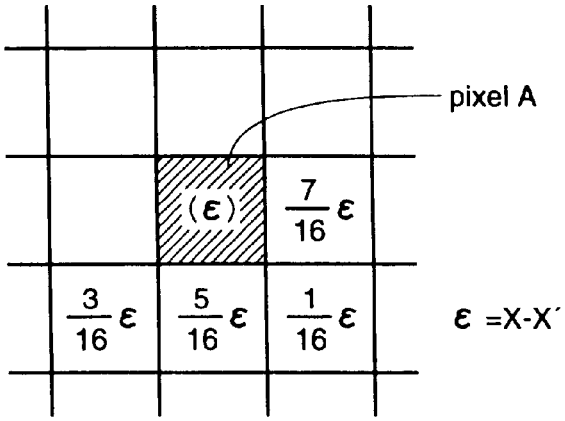
FIG. 5 (PRIOR ART)
FIG. 5 is an explanatory diagram for explaining the multi-gradation error diffusion method by the conventional printing head during printing operation.
Figure 6:
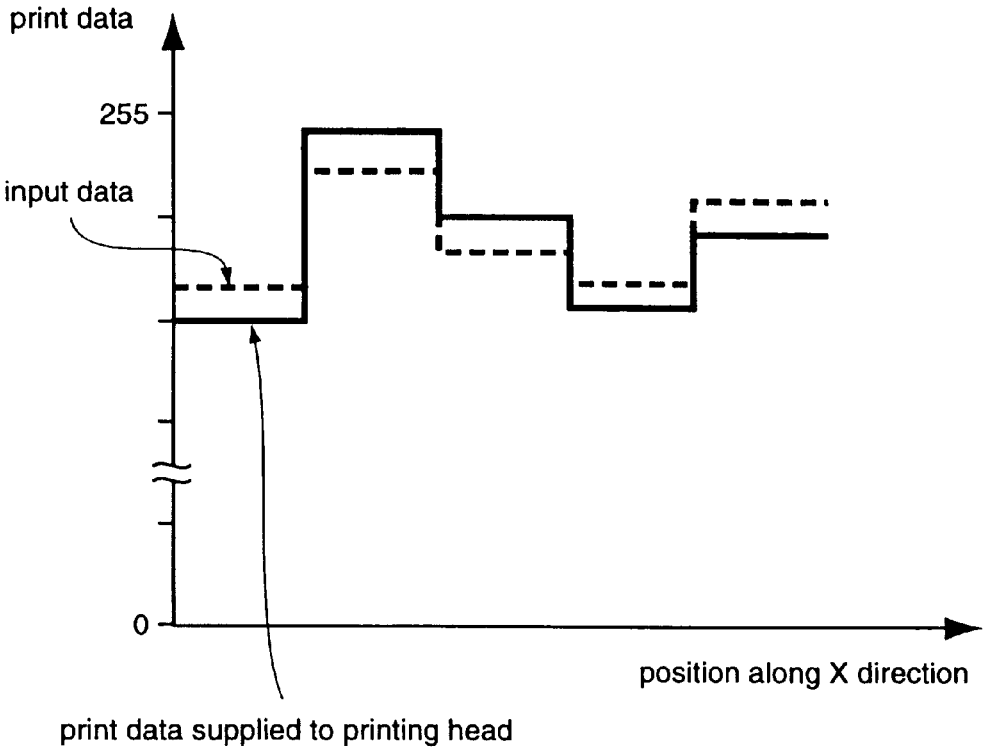
FIG. 6 (PRIOR ART)
FIG. 6 is a waveform diagram for indicating print data supplied to the conventional printing head.

In this embodiment, in a two-fluid mixing type ink jet printer (so-called "carrier jet type printer"), a multi-gradation dither method typically known as the multi-gradation error diffusion method is employed as an intermediate gradation representing means. Since this method is carried out in a similar manner to that described in FIG. 5, explanations thereof are omitted in the following descriptions.

As previously described, it should be noted that when an image to be printed out owns continuous expansion higher than constant density, it could not be avoided such a conventional problem as, spread and mixture of ink droplets. It should be understood that "constant density" indicates the following minimum printing density. A total amount of ink (soluted) fluids jetted from the respective heads in a certain portion is determined by characteristics of ink fluids, characteristics of recording papers, and printing speeds. However, ink on a recording paper is spread, and ink droplets are mixed with each other, so that color reproducing characteristics are deteriorated, resulting in lowering of image qualities and deteriorating of resolution, which will start at the minimum printing density.

Accordingly, in accordance with this embodiment, the multi-gradation dither method is applied to such a portion that ink density is spread higher than a constant density. As illustrated in FIG. 7, the supply of print data to the printing head is interrupted in a certain constant interval in order to stop jetting of the ink fluid from this printing head.

In other words, the multi-gradation error diffusion method is applied to the two-fluid mixing type ink jet printer, and the printing head is so arranged as to stop the ink jetting operation at the low printing density portion. For example, the input data is converted into such print data by which jetting of the ink fluid from the printing head is stopped every 1 dot, and both this input data and the print data to the printing head are distributed to peripheral pixels thereof in accordance with the rule of the multi-gradation error diffusion method.

That is, as shown in FIG. 8A, it is now assumed that a pixel "A" is the above-described specific dot, error portions are distributed to the pixels (dots) around this specific dot, and as indicated in FIG. 8B, the image level itself of the pixel A is further distributed to the peripheral pixels so as to be set to a zero level. As a result, jetting of the ink is not executed as to the pixel A, which is performed every constant interval, so that the print data as shown in FIG. 7 can be obtained. It should be noted that there is substantially no adverse influence caused by the pixel skips produced when jetting of the ink is not carried out as in the pixel A.

In this manner, the print data to the printing head every 1 dot (otherwise, every more than 2 dots) is converted into a value (e.g., "00") for implying "no ink is injected", and the ink is not actually jetted. As a consequence, the total ink amount of a predetermined region involving its peripheral portion may be suppressed to such an amount lower than the ink amount (above-described constant density) corresponding to the print data, which is determined based on the characteristic of the recording paper under use and at which the image quality is started to be deteriorated.

As a result, since there is a small mutual influence of the ink droplets located adjacent to each other caused by the spreads of ink droplets on the recording paper and delays in dry, even when the printing operation is performed in a plurality of colors, the color reproducing characteristic can be improved, so that the image quality can be improved and the resolution can be improved. There are effects that various sorts of low-cost recording papers can be used, and the printing speed can be increased.

Figure 19:
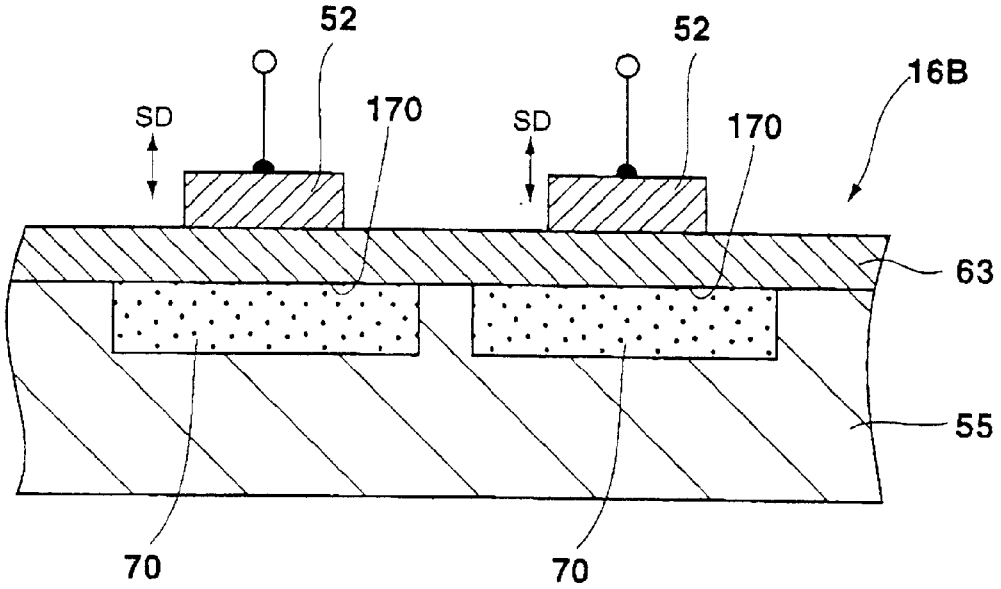
FIG. 19 is a sectional view of the printing head, taken along a line of XIII—XIII of FIG. 18.
Figure 21:
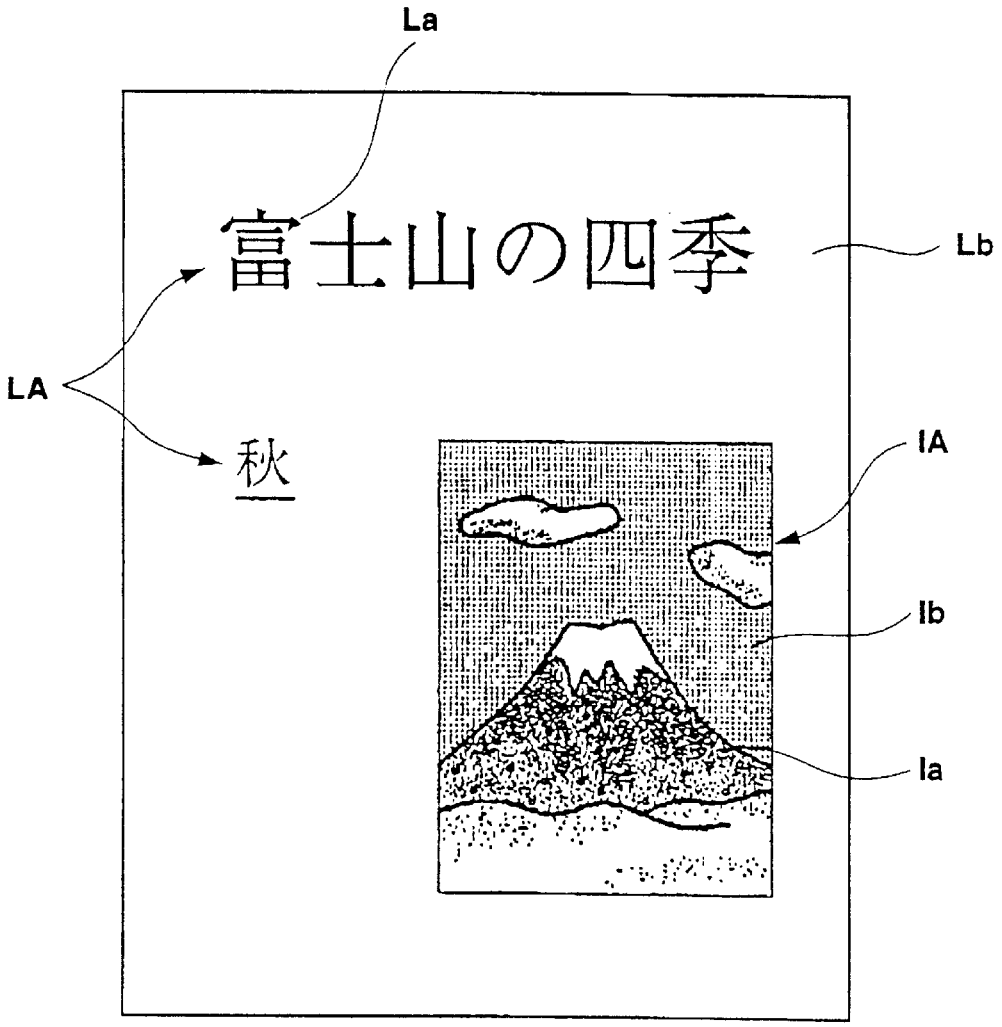
FIG. 21 schematically illustrates an image printed by the ink jet printer according to the present invention.

First, referring now to FIG. 19 and FIG. 21, a recording method by an ink jet printer according to the present invention will be briefly described.

In this embodiment, as illustrated in FIG. 21, when an image constructed of a character region "LA" and an image region "IA" is formed into a single print by employing a two-fluid mixing type ink jet printer (so-called "carrier jet type printer" explained later), the following recording method is executed.

(1). A printing method suitable to print out a character is used so as to print out the character region LA. Concretely speaking, printing of a character "La" is expressed by two values, namely, indicating whether or not ink (including black) or a mixed ink fluid is jetted from a printing head based on recording data. No recording data is outputted in a portion "Lb" other than the character "La", and the jetting operation of either the ink fluid or the ink is stopped.

In this case, the ink fluids (solutions) mixed in the maximum density are jetted into the character portion La of the character region LA during the multi-color printing operation by using the respective color printing heads in cyan; magenta; and yellow, or in cyan; magenta; yellow; and black. Otherwise, these color printing heads are combined with each other, if necessary. In the portion Lb other than the character portion La, none of the ink fluid and the dilution fluid is jetted.

In such a printing condition that the character portion La of the character region LA cannot be represent in the multi-color mode, an ink fluid (solution) produced by mixing proper amounts of ink is jetted by employing the respective color printing heads in cyan; magenta; and yellow, or in cyan; magenta; yellow; and black. Otherwise, these color printing heads are combined with each other, if necessary. In the portion Lb other than the character portion, none of the ink fluid and the dilution fluid is jetted.

(2). Since the image region IA is required to be printed out in a half-tone (having gradation), the printing method capable of reproducing the half tone is employed which is suitable to print out the image. In a concrete example, an ink fluid (solution) which is modulated based on density is jetted to represent the half tone. At this time, the images (main image printing portion Ia and background Ib) in the image region IA are printed out by introducing the following methods (a) to (d).

(a). In all cases, a mixture fluid is jetted irrelevant to a value of input data.

(b). While the input data is at a zero level (00), or is nearly equal to this zero level, even when no mixture fluid is jetted at this time, if no adverse influence is given to the image quality of the image print, then jetting of this mixture fluid is stopped.

(c). In the above case (b), when all of the mixture fluids or the color ink in cyan; magenta; and yellow, or cyan; magenta; yellow, and black are not jetted to a certain pixel (namely, when all of data are "00"), the dilution fluid is jetted from at least any one of these printing heads. As a consequence, even when the main image printing portion Ia is not formed, gloss is produced by drying of the dilution fluid (transparent solution), involving the background Ib, so that the image quality can be increased. Conventionally, when all of the input data are "00", no dilution fluid is jetted also to the background Ib, but all of fluid jetting operations are stopped.

(d). In the above case (c), the nozzle selected so as to jet the dilution fluid is used for the cyan color. That is, as easily understood from a nozzle structure (will be discussed later) shown in FIG. 11, since the nozzle for the ink is located very close to the nozzle for the dilution fluid, a portion of the ink is adhered to the nozzle jetting port for the dilution fluid and then is left at this nozzle port while the mixture fluid is repeatedly jetted. Accordingly, even when only the dilution fluid is jetted, there are some possibilities that while a predetermined amount of ink is melted, the melted ink is jetted.

In this case, when the solution for the cyan color is jetted as the dilution fluid, a portion of the color ink for cyan is mixed with this solution, and then the mixed solution is jetted. If this mixed solution is adhered to the background Ib, the color of this background after this adhesion and dry may be observed as white like color, because the color temperature is increased by this cyan color. As a result, the contrast between the image IA and other regions can be increased (otherwise, when main image printing portion Ia is formed, it is possible to form it as background color Ib). This factor may provide a particular effect when the color of the recording paper is not equal to pure white.

FIG. 9 to FIG. 14 represent a sequential operation in the case that the above-described recording method is applied to a two-fluid mixing type ink jet printer (carrier jet type), a circuit arrangement thereof, and a useable printing head.

A first description will now be made of a circuit operation for executing the recording (printing) method. The below-mentioned operations are sequentially executed by a CPU (central processing unit) 5 in accordance with a program stored in a ROM (read-only memory) 6.

1). Input data to be printed out is fetched via a data input interface 4 (will be referred to as an "I/F" hereinafter), and then is stored into a RAM (random access memory) 7. The data input I/F 4 controls in such a manner that the input data does not overflow from the RAM 7, and stops the input data in response to an input data control signal at the time when the RAM is fully filled with the input data.

At this time, when the RAM size can store the overall image to be printed out, the process operation may be advanced to the next process operation after all of the input image data have been stored into the RAM. To the contrary, when the RAM size cannot store the entire image to be printed out, the RAM may store such a line number larger than the line number actually used during a single scanning operation of the printing head, and may stop the input data in response to the input data control signal.

2). At such a stage that the number of input data to be printed, which have been stored in the RAM reaches the number of lines actually used during a single scanning operation of the printing head, information about a temperature sensor 40 such as a thermistor attached to the ink jet printing head is measured as temperature measurement data via a sensor I/F 41. A calculation is made of a difference between the measurement temperature calculated in this case and a standard operation temperature of this printing head, namely temperature predicated in a designing work. Then, a correction curve with respect to the input data corresponding to this temperature difference is obtained (namely, a curve indicative of a correction amount with respect to a value of the input data).

The relationship between this temperature difference and the correction curve to the input data corresponding thereto has been determined when the printing head, the ink, the recording paper, and the like have been developed. It should be noted that this correction curve may be equal to the values of the all input data, and may be different from the values of the all input data. This is mainly obtained from the actual measurement during developing stages.

When this correction curve is determined, the input data is converted based on this correction curve into corrected print data. It should also be noted that the input data correction by this temperature measurement is not always required.

3). After the input data has been converted into this corrected print data, the corrected print data is replaced by image data to be actually printed out in accordance with the multi-gradation error diffusion method. The replaced image data is stored into another storage area of the same RAM 7. This multi-gradation error diffusion method will be explained later. It should be noted that the plural number of gradation in the multi-gradation error diffusion process is normally selected to be 4, 6, 8, 16, 32, and 64 stages.

A relationship between this gradation number and levels of voltages applied to an electrostrictive vibrator 52 may be determined based upon an unstable factor of deviation in the piezoelectric vibrator (namely, a change in an applied waveform caused by having a hysteresis characteristic and an electrostatic capacity), an unstable factor in an overall head modulating operation (namely, an error in a modulation characteristic caused by fluctuations in assembling of a head, and fluctuations in a modulation characteristic caused by physical characteristics such as viscosity of ink, and characteristics of a vibrating plate), and also a relationship between a variation of applied voltages and a density variation in ink dots on a recording paper. It should be understood that the electrostrictive vibrator 52 may induce such a phenomenon that when an electric field is applied to a dielectric member, this dielectric member is deformed and distorted (will be referred to as a "piezoelectric element" hereinafter).

4). As previously described, when the print data replaced on the RAM 7 are stored, the quantity of which is equal to the quantity for driving the ink jet printing head (in the case of a head drive type printer having several tens of nozzles of an ink jet head, the number of the print data is equal to that of the head for 1 scanning operation), the print data to be printed out is fed as a print data signal to a D/A converting unit 13. At the same time, a motor drive control signal is sent to a motor control unit 19 so as to thereby drive a head feed motor. A motor drive unit 20 is provided between the motor control unit 19 and each motor 21, and this motor drive unit 20 drives the signals up to such a voltage value and a current value capable of driving the motor.

5). When the head feed motor 21 is initiated, so that the nozzles of the printing head 16 reach positions to be printed out on the recording paper, this timing is sensed by a timing control unit 18 by receiving a sensor output from a head position detecting sensor 17. Then, the timing control unit 18 outputs a D/A-converted trigger signal to the D/A converting unit 13. The timing control unit 18 also outputs a motor drive trigger signal to the motor control unit 19.

6). In the D/A converting unit 13, the image data to be printed, which is contained in the print data signal, is converted into a predetermined voltage level. This has been explained in the above-described stage 3).

7-1). The power of such a modulating vibrator drive signal corresponding to the image data, whose level has been converted into a certain voltage level, is amplified by the modulating vibrator drive unit 15 in such a manner that the modulating piezoelectric vibrator can be deviated by this amplified. The amplified drive signal is entered as a modulating vibrator application signal to a printing head modulating unit 37. In the printing head modulating unit 37, the quantifying operation of the ink, and also the mixing operation with the ink and the solvent are carried out.

7-2). After the modulating vibrator application signal has been applied to the printing head modulating unit 37 only during a predetermined constant time period, or only during time corresponding to the print image data signal, this modulating vibrator application signal is invalidated, so that the mixing operation with the ink and the solvent (dilution fluid) by the printing head modulating unit 37 is accomplished.

7-3). After this mixing operation is ended, the timing control unit 18 outputs jet timing signal to a jetting vibrator drive unit 38. The power of this jetting timing signal is amplified by the jetting vibrator drive unit 38 in such a manner that the jetting piezoelectric vibrator can be deviated by this amplified power. Then, the amplified jet timing signal is entered as a jetting vibrator application signal to the printing head jetting unit 36. In the printing head jetting unit 36, a preselected amount of ink modulated by the printing head modulating unit 37 in response to the image information is supplied. This ink is mixed with the solvent, and then the mixed ink is jetted as an ink (saluted) fluid, so that ink dots having desirable density are formed on the recording paper.

7-4). When the first ink dots are formed on the recording paper in this manner, the second ink dots are formed. That is, the image data to be subsequently printed, which has been replaced on the RAM, is fed as a printing data signal to the D/A converting unit 13.

7-5). The above-described operations defined in the items 6 to 7-4) are repeatedly performed.

8). A paper feed motor 21 feeds the recording paper in synchronism with driving of the printing head, if necessary.

9). Since all of the above-explained operations are repeatedly performed, the paper feeding operation, the head feeding operation, the voltage application to the printing head, and also the ink ejecting operation are carried out.

In the above-explained operations defined in the items 1) to 9), since the data as indicated in FIG. 7 and FIG. 8B is obtained from the input data based on the multi-gradation error diffusion method and then the resultant data is supplied as the modulating signal to the printing head, when a single pixel is formed, the ink is adhered to the recording paper, and no recording operation is performed just after this ink adhesion. As a consequence, the ink on the recording paper is fixed, and this fixed ink is not mixed with another ink which is subsequently adhered to the adjoining position (or the same position) so as to form the next pixel.

Although the data converting process based on the multi-gradation error diffusion method is carried out in the printer in the above-described operation, these data conversion processes may be executed by a computer and processed results may be transferred to the printer.

As a consequence, it is possible to minimize such problems that the ink on the recording paper is spread, and the ink droplets are mixed with each other. Even when the printing operation is performed in a plurality of colors, the color reproducing characteristic can be improved, so that the high image quality can be obtained and the high resolution can be achieved. Therefore, in the two-fluid mixing type printer (so-called "carrier jet type printer"), the unnecessary jetted ink fluids are not jetted onto the recording paper, so that the adverse influences given to the image quality can be minimized, and the desirable intermediate gradation (gradation characteristic) can be made better.

Also, the above-described particular effects may be achieved in the following cases, for instance, when a print-dedicated recording paper is used as the recording paper (namely, when general-purpose recording papers such as low-cost normal papers and reproduced papers are used), when printing environmental temperatures are low, and when the printing head is scanned in high speed. As a result, such low-cost recording papers may be used, resulting in a merit of cost. There are many advantages in using environments and operation environments.

In a series of such operations, as a concrete means capable of recording the character region LA and the image region IA as described in the above items (1) and (2), the following means (I) to (III) are realized:

(I). In a digital processing unit, the character region is separated from the image region to thereby produce a signal indicative of this character region and a signal representative of this image region. These signals are entered to the respective printing head drive circuits. As a result, the mixture fluid jetting operations by the respective printing heads are performed at the character portion in the character region, whereas both the mixture fluid jetting operations and the dilution fluid jetting operations by the respective printing heads are performed at the portions other than the character portion are stopped.

(II). In the digital processing unit, the data in the character portion of the character region is set to (0.1) or other values, and the data in portions other than this character portion is set to (0, 0) (namely, no dilution fluid is also jetted). Also, in the image region, the data indicative of the minimum density of the mixture fluid is set to (01) in the above-described case (a). Within this image region, the data is set to (01), which represents the minimum density when the mixture fluid is jetted, and the data when neither the mixture fluid, nor the dilution fluid is jetted is set to (00) in the above cases (b), (c), (d).

The data are converted in the above-described manner in the digital processing unit, and then when the data applied to the drive circuits of the respective printing heads are equal to (0, 0), neither the mixture fluid jetting operation, nor the dilution fluid jetting operation is carried out.

(III). In the above-explained case (II), the data when neither the mixture fluid nor the dilution fluid is jetted is converted into (00), and also the data when the mixture fluid is jetted is converted into (01) or other values. In such a case that the mixture fluid is not jetted while the data are not converted as described above, data used to stop the jetting operation is separately added thereto. Then, the resulting data are entered into the respective head drive circuits with respect to the respective pixels, so that the jetting operation of the mixture fluid is stopped.

It should be understood that in the above-described operation, the print information may be formed in, for example, 8 bits=256 gradation. To the contrary, when the intermediate gradation (half tone) printed out in the printer apparatus is small (for example, 6 bits=64 gradation), the gradation extending method such as a so-called "multi-gradation dither method (as one example, a multi-gradation error diffusion method) is utilized.

That is to say, for example, in the multi-gradation error diffusion method, as represented in FIG. 8, a level of an arbitrary pixel "A" for constituting an image is replaced from an originally printed level X (256 gradation) into an actually printed level X' (normally, 4, 6, 8, 16, 32, 64 gradation, in this case 64 gradation). In this case, the following methods are employed. That is, the level X' to be replaced is set to the level being nearest the level X. Alternatively absolute values of differences between plural levels realized by the level X' and the level X are replaced as probabilities. In the latter method, there are possibilities that the level X' is replaced by all of the realizable levels.

Moreover, an error portion "$\epsilon$" between the level X and the level X' is distributed to pixels around the pixel "A" so as to be added. As indicated in FIG. 8, as to this distribution method, there are the following methods. In one distribution method, (7/16)$\epsilon$ is distributed to a pixel subsequent to the pixel A, (3/16)$\epsilon$ is distributed to a pixel before the next scanning line, (5/16)$\epsilon$ is distributed to a pixel just under the pixel A, and (1/16)$\epsilon$ is distributed to a pixel after the next scanning line. In another distribution method, the error portion is distributed only to an arbitrary one pixel at probability of the respective distribution rates.

It should be noted that the error portion $\epsilon$ owns codes of "±". The errors of the peripheral pixels to which the errors have been distributed are calculated as to the value, added with the distributed errors. Furthermore, when the value added with the distributed error exceeds a maximum printing level or a minimum printing level in a printable range, the value exceeding this maximum printing level or minimum level may be clipped. Otherwise, this exceeding portion is again distributed to the peripheral pixels in the above-described rate, or probability in a similar calculation manner to the above error portion "$\epsilon$".

In this manner, the error portion $\epsilon$ of the pixel A is distributed to the peripheral pixels, so that the printing error is distributed. This is carried out over the overall input image to thereby form image data to be printed. As a result, the gradation of the image which is obtained by printing out the print information can be essentially enlarged (for example, 64 gradation is extended into 256 gradation). The above-described distribution rate and numeral values are merely one example, and therefore may be varied in accordance with the differences of the gradation to be converted, and ranges (number) of pixels to which the error portions are distributed.

As a consequence, for instance, since the above-described dither method is employed in the host computer, the print information of 64 gradation which can be printed by the printer apparatuses can be formed from the print information of 256 gradation (=8 bits) formed in the host computer. Then, in this case, for example, the print information of 64 gradation is expressed by, for instance, 6 bits.

Figure 9:
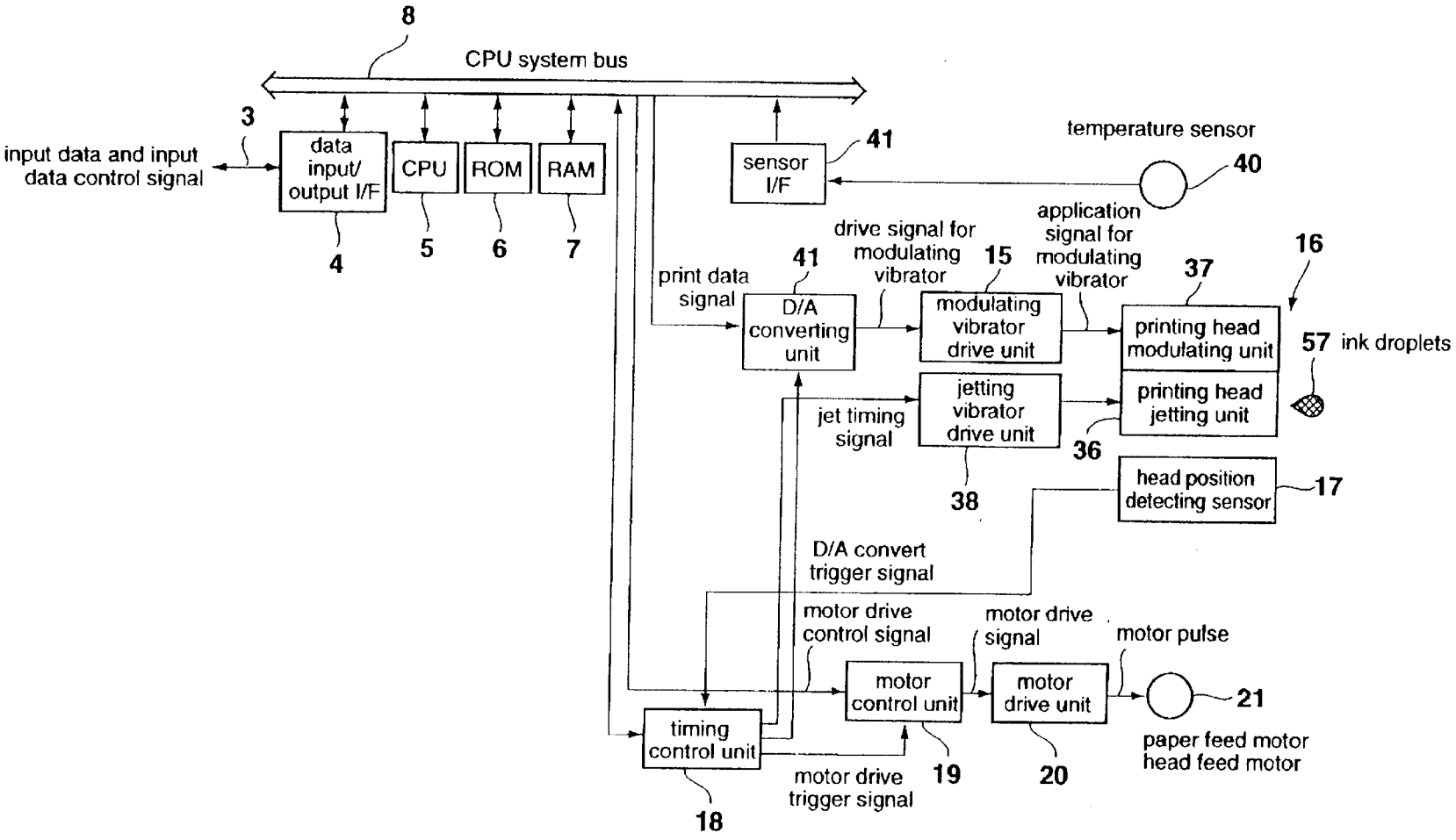
FIG. 9 is a schematic block diagram for representing a circuit used to drive an ink jet printer apparatus according to the present invention.
Figure 10:
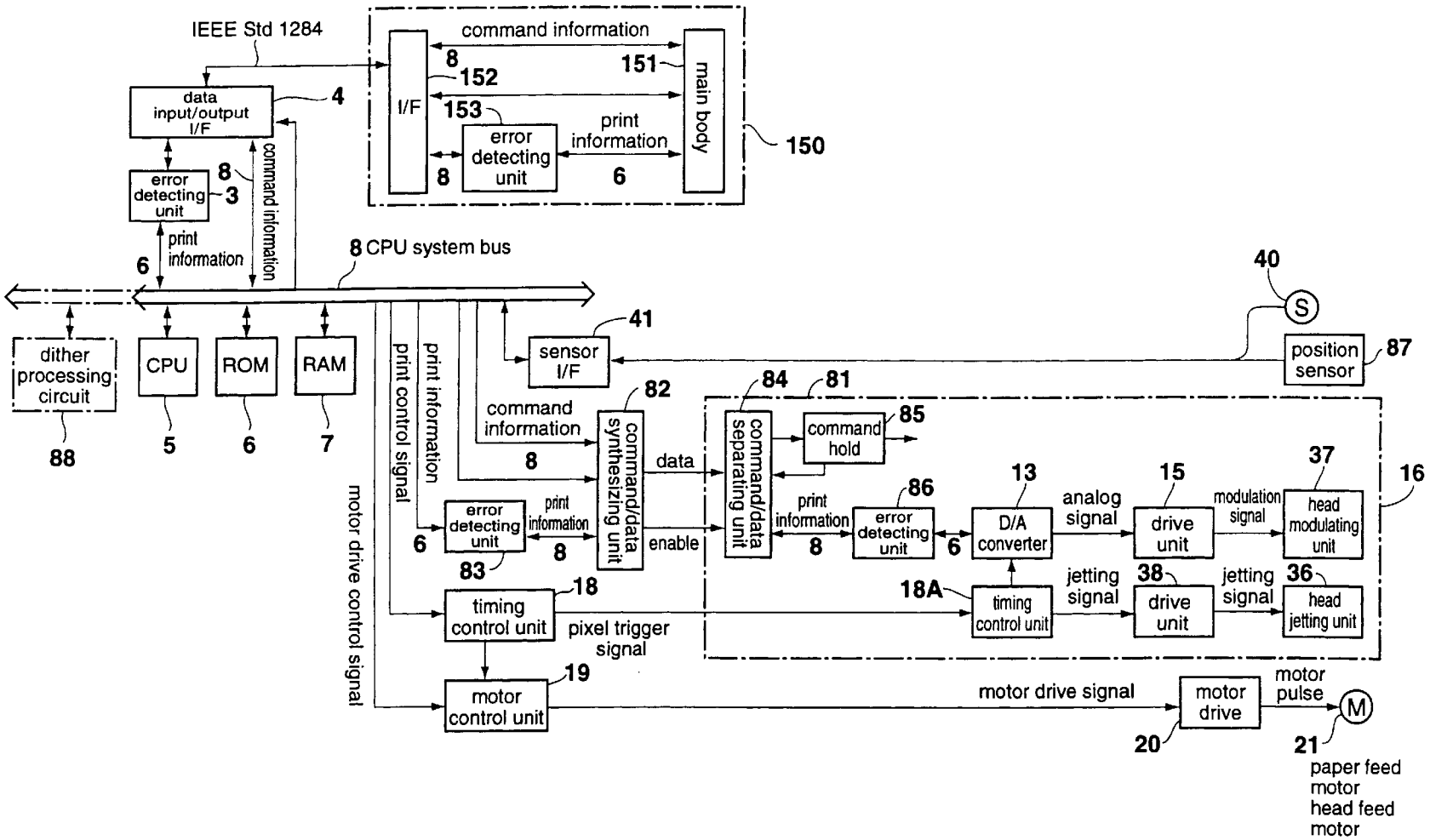
FIG. 10 is a block diagram for showing the drive circuit of FIG. 9 more in detail.

FIG. 10 is a circuit arrangement for indicating more in detail the circuit arrangement of the ink jet printer shown in FIG. 9. In FIG. 10, for instance, the image information (print information also containing information acquired by the below-mentioned dither method) produced by a host computer 150 (building the dither processing unit), and the command information of the printing operation are supplied to the printer apparatus by employing the data interface (I/F) defined by, for example, Centronics, BiCentronics (IEEE Std. 1284), SCSI (so far parallel modes), and RS232C, RS422 (so far, serial mode).

In the interface (BiCentronics) defined by the above-described IEEE Std. 1284, for example, 1st to 36th transmission paths are provided. Then, the 1st transmission path among these transmission paths is caused to be strobe (enable), and 8-bit information is transmitted through the 2nd to 9th transmission paths.

For example, 8-bit command information produced in a main body 151 of the host computer 150 is directly supplied to the interface (I/F) circuit 152, and then is transmitted via the 2nd to 9th transmission paths.

To the contrary, the print information is formed as, for instance, 6-bit data in accordance with the performance of the printing head in the main body 151 of the host computer 150 (will be discussed later). Then, this 6-bit print information is transmitted via the 4th to 9th transmission paths which constitute MSB-sided transmission paths, and the error detection data with respect to the 6-bit print information is provided in the 2nd transmission path which constitutes an LSB-sided transmission path, as an example.

In other words, for instance, the 6-bit print information derived from the main body 151 is supplied to an adding circuit 153 of error detection data. Then, in this adding circuit 153, 1-bit error detection data is produced with respect to the above-described 6-bit print information, for instance, when an even parity, an odd parity, or all of the 6 bits become "1", this 1-bit error detection data of "0" is produced, and/or when all of the 6 bits become "0", this 1-bit error detection data of "1" is produced.

It should be understood that these error detection data are arbitrarily selected in accordance with the printer using environments. That is, for instance, under such an environment that a power supply path for a high voltage is located near the transmission path and therefore an error will easily occur where all of 6 bits become "1" or "0", such error detection data of "0" is selected when all of 6 bits become "1", and/or such error detection data of "1" is selected when all of 6 bits become "0".

In the case that there are plural factors in the error occurrence, for instance, a high frequency (RF) signal producing source is located near the transmission path, either the even parity or the odd parity is selected as the error detection data. Furthermore, these error detection data may be arbitrarily selected. Then, the selected error detection data may be transferred to a reception side (will be explained later) in response to the corresponding command information so as to be processed.

In addition, this 1-bit error detection data is added to the 8-bit LSB produced by adding the print information to the 6 bits on the MSB side. Then, the 8-bit print information added with this error detection data is supplied to the interface circuit 152, and then is transmitted through the 2nd to 9th transmission paths. It should be noted that the 3rd transmission path is set to "empty" in this example, and the designated data is provided to be transmitted.

Then, the control signal supplied from the main body 151 is supplied to this interface circuit 152, so that the above-described command information and print information are arbitrarily selected to be transmitted.

It should be noted that as to the above-described command information, the following designation commands are transmitted, for example, (designating command of print mode)+([full color high image quality/full color normal paper/black and white image/character] designating parameters), (designating command of print information transfer system)+([compressed/non-compressed] designating parameters), (designating command of interleave operation)+([execute/non-execute] designating parameters.

Also, as to the above-described command information, the following setting commands are transmitted, for instance, (setting command in unit of a reference along a main scanning direction)+(setting command of a minimum unit distance length as a reference), (setting command in unit of a reference along a sub-scanning direction)+(setting parameter of a minimum unit distance length as a reference), (setting command of printing speed)+(setting parameter), (setting command of resolution)+(setting parameter).

As to the above-explained command information, a portion of the command information is transferred which is transferred from the printer main body to the circuit block containing the printing head. Then, these command information may be transmitted in a batch mode in a random sequence when the printing operation is commenced.

Furthermore, as to the above-explained command information, the following parameters and commands are transmitted, for example, (setting command of printing position movement along main scanning direction)+(setting parameter of print starting position), (setting command of printing position movement along sub-scanning direction)+(setting parameter of print starting position), (setting command of the number of print data to be transferred)+(setting parameter of the number of data transfer), (data transfer end command), and (end command of printing operation). These command information is arbitrarily transmitted in connection with the parameter changes.

When the above-mentioned (setting command of number of print data to be transferred)+(setting parameter of number of data transfer) is formed in the main body 151, a control signal derived from this main body 151 is supplied to the interface circuit 152, so that the print information is selected to be switched from the above command information. As a consequence, thereafter, the print information added with the error detection data is transferred by the adding circuit 153.

Furthermore, the transmission of this print information is carried out plural times every time the above-explained setting parameter of the number of data transfer is set. When the transmission of this set number is performed, the control signal derived from the main body 151 is again supplied to the interface circuit 152. In this case, the command information is selected to be switched from the print information. Then, the above-described (data transfer end command) is transferred, and thereafter the command information is transmitted.

In this manner, for instance, the command information and the print information formed in the main body 151 of the host computer 150 are transmitted to the interface (BiCentronics) defined by, for example, IEEE Std. 1284 from the interface circuit 152.

Thus, the transmitted command information and print information are received by the data input/output interface (I/F) circuit 4 of the printer apparatus. Then, the command information received by this interface circuit 4 is directly supplied to the CPU system bus 8 employed in the printer apparatus. It should be noted that the CPU (central processing unit) 5, the ROM (read-only memory) 6, the RAM (random access memory) 7, and other circuit mechanisms for the printing operation are connected to this system bus 8.

Then, for instance, the above-described command is supplied to the CPU 5 so as to judge, for example, the above-explained (setting command of number of print data to be transferred)+(setting command of number of data transfer). Furthermore, when this command information is judged, the control signal is supplied to the interface circuit 4, so that, for example, the received data is switched to be supplied to the error detecting circuit 3.

Thus, in this error detecting circuit 3, the error of the transmitted print information is detected by employing the error detection data added in the adding circuit 153 of the host computer 150. Then, when no error is detected, the 6 bits information on the MSB-sided print information transmitted is directly supplied to the system bus 8.

To the contrary, when the error is detected from the print information transmitted in the error detecting circuit 3, a correcting process is carried out with respect to the print information from which the error is detected. In other words, in this correcting process, for instance, the print information corresponding when the error is detected is replaced by empty data. Otherwise, the corresponding print information is replaced by the immediately preceding data.

Also, this error correcting process may be carried out in conjunction with the CPU 5 and the RAM 7. In this case, the corresponding print information is replaced by either data appearing in the adjacent scanning lines, or average value data thereof. Furthermore, another process operation may be carried out by which the retransmission of the print information from which the error is detected is requested to the host computer 150.

Also, for example, the command information formed in the CPU 5, which will be supplied to a head carriage (circuit block including printing head) 81, is supplied to the system bus 8. In addition, the command information supplied to this head carriage 81 is supplied to a synthesizing circuit 82 for synthesizing the command information from the system bus 8 with the print information therefrom.

On the other hand, the print information (6 bits) is supplied from the system bus 8 to a circuit similar to the adding circuit 153 of the error detecting data, or the adding circuit 83 of arbitrary error detecting data. Then, such print information (8 bits) to which the error detecting data has been added by this adding circuit 83 is supplied to the synthesizing circuit 82 for synthesizing the command information with the print information.

Then, the data derived from this synthesizing circuit 82 is supplied together with an enable signal to a separating circuit 84 for separating the command information from the print information on the head carried 81. In this case, since the synthesizing circuit 82 employed on the main body side of the printer, and the separating circuit 84 on the carriage 81 are provided in the same casing in the normal condition, the specification of the data transmission between these circuit 82 and 84 may be arbitrarily determined.

However, as to the command information, for example, the data transmission path having an 8-bit width is usually employed also in the transmission path between the synthesizing circuit 82 and the separating circuit 84, because the command information system from the host computer 150 is desirable maintained, and furthermore, the weight of the transmission path could not be made heavy in order to smoothly performing the reciprocating motion of the head carriage 81.

As a consequence, even in the adding circuit 83, for example, with respect to the original 6-bit print information, when an even parity, an odd parity, or all of 6 bits become "1", such 1 bit error detecting data of "0" is produced, and/or when all of 6 bits become "0", such 1 bit error detecting data of "1" is produced. Then, this 1 bit error detecting data is added to the 8-bit LSB in which the 6-bit print information is provided on the MSB side.

The command information and the print information, which have been formed as e.g., 8-bit information in the above-described manner, are supplied to the synthesizing circuit 82. Also, for instance, the control signal formed in the CPU 5 is supplied to the synthesizing circuit 82, so that the above-explained command information and print information are arbitrarily selected to be transmitted.

These transmitted command information and print information are supplied to the separating circuit 84 for separating the command information from the print information, provided on the head carriage 81. Then, the command information separated from this separating circuit 84 is directly supplied to a setting command holding means 84 provided on the head carriage 81. Furthermore, the set value and the like held by this holding means 85 is supplied to the respective circuit apparatuses provided on the head carriage 81.

For instance, the above-explained (setting command of number of print data to be transferred)+(setting parameter of data transfer number) is discriminated from the above-described command information. Then, when this command information is discriminated, the control signal to the separating circuit 84, so that the data switching operation is performed in such a manner that, for example, the data supplied to the separating circuit 84 is supplied to the error detecting circuit 86 on the head carriage 81.

In addition, in this error detecting circuit 86, the error contained in the transmitted print information is detected by employing in the adding circuit 83. Then, when no error is detected, the transmitted print information is directly supplied to the D/A converting unit 13 provided at the post stage, and converted into an arbitrary analog signal.

To the contrary, when the error is detected from the print information transmitted from the error detecting circuit 86, a correction process operation is carried out for the print information from which the error is detected. That is, in this correction process, the print information corresponding to the information when the error is detected is replaced by the empty data. Then, the print information to which the correction process is carried out is supplied to the above-described D/A converting unit 13.

Furthermore, the analog signal converted by this D/A converting unit 13 is supplied to a drive unit 15. In this drive unit 15, for instance, in accordance with the level of the above converted analog signal, such a modulation signal is produced in which a time period defined from "d" to "e" of FIG. 13B, and a potential change width are modulated. Then, the modulation signal from this drive unit 15 is applied to the modulating unit 37 of the printing head.

Also, the print control signal derived from the system bus 8 is supplied to a timing control unit 18. Then, a pixel trigger signal derived from this timing control unit 18 is supplied via an arbitrary transmission path to a timing control unit 18A on the head carriage 81. Then, a D/A-conversion trigger signal derived from this timing control unit 18A is supplied to the D/A converting unit 13, and thus the above-explained print information is analog-converted at the timing of this trigger signal.

Figure 13A:
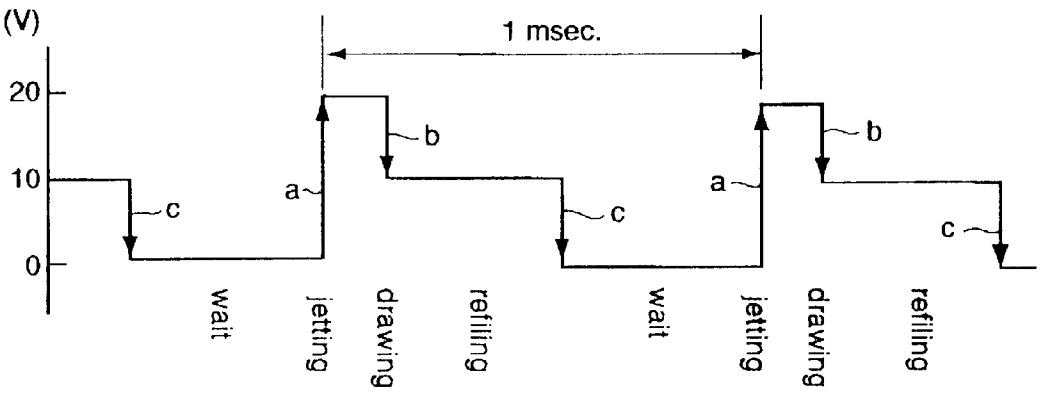
FIGS. 13A and 13B are waveform diagrams for explaining operations of the printing head of FIG. 11.

Also, in this timing control unit 18, for instance, a jet timing signal as shown in FIG. 13A is produced. Then, this jet timing signal is supplied to the drive unit 38, and a jetting signal derived from this drive unit 38 is applied to a jetting unit 36 of the printing head.

Figure 11:
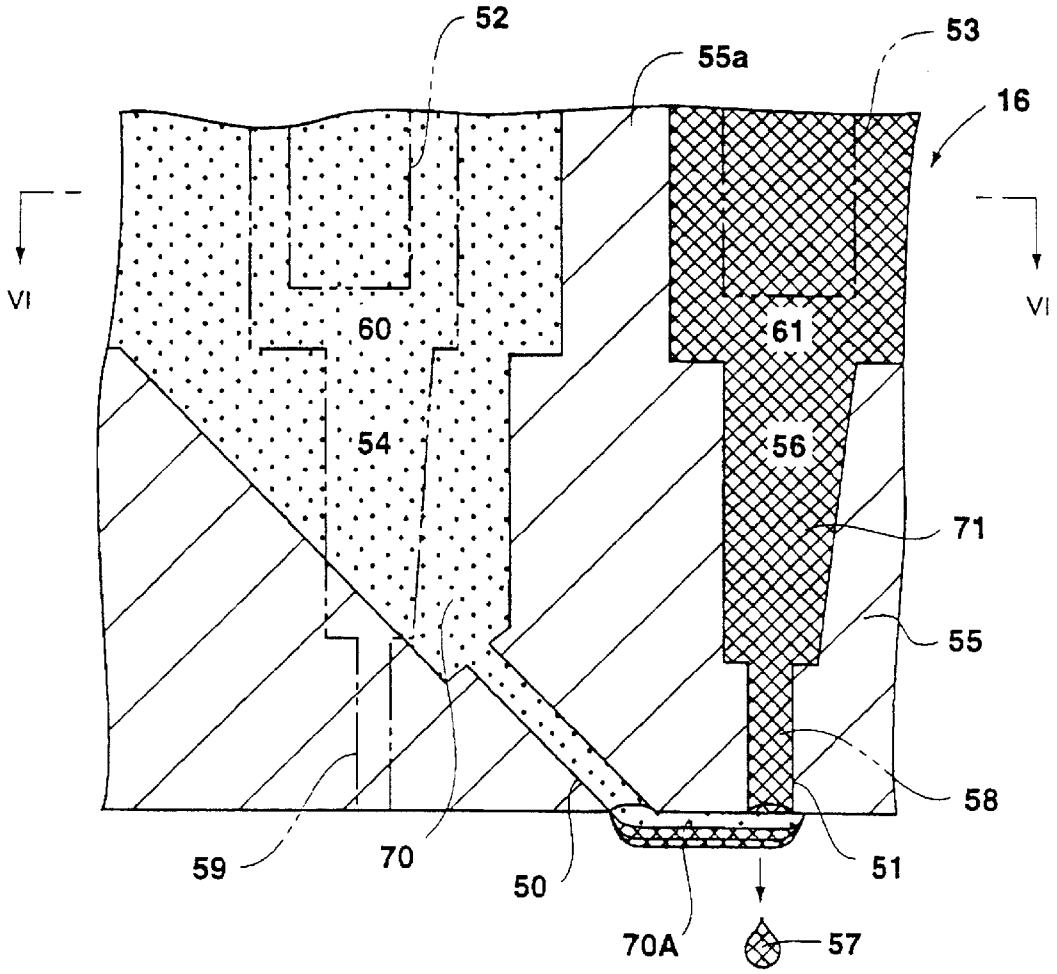
FIG. 11 is a sectional view for representing an example of the printing head of the ink jet printer according to the present invention.

Furthermore, in FIG. 11, only one nozzle of a single printing head is illustrated. As will be discussed later, in such a case that a plurality of nozzles of the plural printing heads are driven with respect to these colors such as cyan, magenta, yellow, black, and the like, there are provided: the D/A converting units 13 to the modulating units 37 for the printing heads, and the drive units 15, 38, and also the jetting units 36 for the printing heads, the total number of which is equal to the total number of nozzles.

As a result, as to the command information used between the main body of the printer and the head carriage 81, for instance, the following designating commands are transmitted, i.e., (designating command of print mode)+(designating parameter of [full color high image quality/full color normal paper/black-white image/characters]), (designating command of printing direction)+(designating parameter of [going scan/returning scan], and (designating command of effective nozzle)+(designating parameter of effective nozzle for [cyan/magenta/yellow/black].

Also, as to this command information, the following setting commands are transmitted, i.e., (setting timing of modulation timing)+(setting parameter for output timing of modulation signal with respect to pixel trigger signal), (setting command of modulation waveform)+(setting parameter of inclination of modulation signal and of pulse length), (setting command of conversion reference value for D/A conversion)+(setting parameter of respective conversion reference values for cyan, magenta, yellow, black).

Furthermore, as to this command information, the following setting commands are transmitted, i.e., (setting timing of jetting timing)+(setting parameter for output timing of jetting signal with respect to pixel trigger signal), (setting command of jetting in waveform)+(setting parameter of inclination of jetting signal and of pulse length), (setting command of effective gradation number within 1 pixel)+(setting parameter of gradation number).

Also, as to this command information, the following setting commands are transmitted, i.e., (setting command of printing range along main scanning direction)+(setting parameters of print starting positions and printing number for cyan, magenta, yellow, black heads), (setting command of error detecting data method)+(setting parameter), and (setting command of error correcting method)+(setting parameter).

Furthermore, as to this command information, the following setting commands are transmitted, i.e., (setting command of print data number to be transferred)+(setting parameter of data transfer number), (data transfer end command), and (end command of print operation). As a consequence, the above-explained print information to which the error detecting data has been added is transmitted subsequent to this (setting command of print data number to be transferred)+(setting parameter of data transfer number).

Then, the transmission of this print information is carried out plural times set by the above-explained (setting parameter of data transfer number). Furthermore, when the print information of this setting number is transmitted, the above-described (data transfer end command) is transmitted, and subsequently the command information is again transmitted. It should be noted that the transmission operations of these print information are performed in a similar manner executed between the host computer 150 and the printer-apparatus.

In FIG. 10, a motor drive trigger signal from the timing control unit 18 is supplied to the motor control unit 19. Also, a motor drive control signal from the system bus 8 is supplied to the motor control unit 19. Then, a motor drive signal derived from this motor control unit 19 is supplied via the motor drive unit 20 to the paper feed motor and the head feed motor 21.

For example, a position detection signal derived from a head position detecting sensor 87 for detecting a position of a head carriage 81 is supplied via a sensor interface (I/F) 41 to the system bus 8, so that driving of the head carriage 81 is controlled. Furthermore, a temperature detection signal from a temperature sensor 40 is supplied via the sensor interface (I/F) 41 to the system bus 8, so that the control operations for the temperature changes (previously explained) as disclosed in Japanese Laid-open Patent Application No. 7-254250 are performed.

As a consequence, when the print information constructed of the bit number smaller than the bit width of the transmission path in this apparatus, the print information is set to the MSB side of the transmission path, and the error detecting data is provided on the LSB side of the transmission path, so that the error measure about the print information can be achieved by very simple means.

Accordingly, for instance, the shield cable, the shielded flat cable, and the shielded flexible substrate, which have be used as the transmission path of the print information in the conventional apparatus, are no longer required in the printer apparatus according to the present invention. Thus, the low-cost cable may be employed, and also such the cable with high flexibility is used, the head carriage can be smoothly transported.

In addition, since the transfer error problem of the print information can be solved, the stability in the operation of the printer apparatus can be extremely improved.

It should be understood in the above-described printer apparatus that the second bit of the print information to be transmitted on the LSB side is set to as "empty" the designated data. In future, this may be left, while predicting such a case that the printing operation can be done by the printing head in 128 gradation. Also, with employment of the 2 bits on the LSB side of the print information, a circulation type error correction code and the like may be employed.

Also, the bit number of the print information to be transmitted is not limited to 6 bits, but may be freely selected to be any bit numbers, if these bit numbers are smaller than the bit width of the transmission path. In this case, the above-explained setting commands such as (setting command of effective gradation number within one pixel)+(setting parameter of gradation number), (setting command of error detecting data method)+(setting parameter), and (setting command of error correcting method)+(setting parameter) are employed so as to set the error detecting circuits 3 and 83 on the reception side.

In addition, the gradation extending method such as the multi-gradation dither method (multi-gradation error diffusion method) is not limitedly provided on the side of the host computer 150. For example, the gradation extending method is build in the printer, the 8-bit print information supplied to the data input/output interface circuit 4 is may be converted into 6-it print information by a dither process circuit unit 88 shown by a virtual line of FIG. 10 by employing the dither method by the CPU 5, the ROM 6, and the RAM 7. In this case, as previously explained, this 6-it print information may be transferred to the head carriage 81.

On the other hand, the Applicant has proposed such a novel printing head by the intermediate gradation (half tone) printing method (carrier jet method) in that one of a dilution fluid and ink is quantified in accordance with the print information, and the other is mixed in a preselected amount to produce a mixture fluid (Japanese Patent Application No. 7-254250 filed on Sep. 29, 1995).

Figure 12:
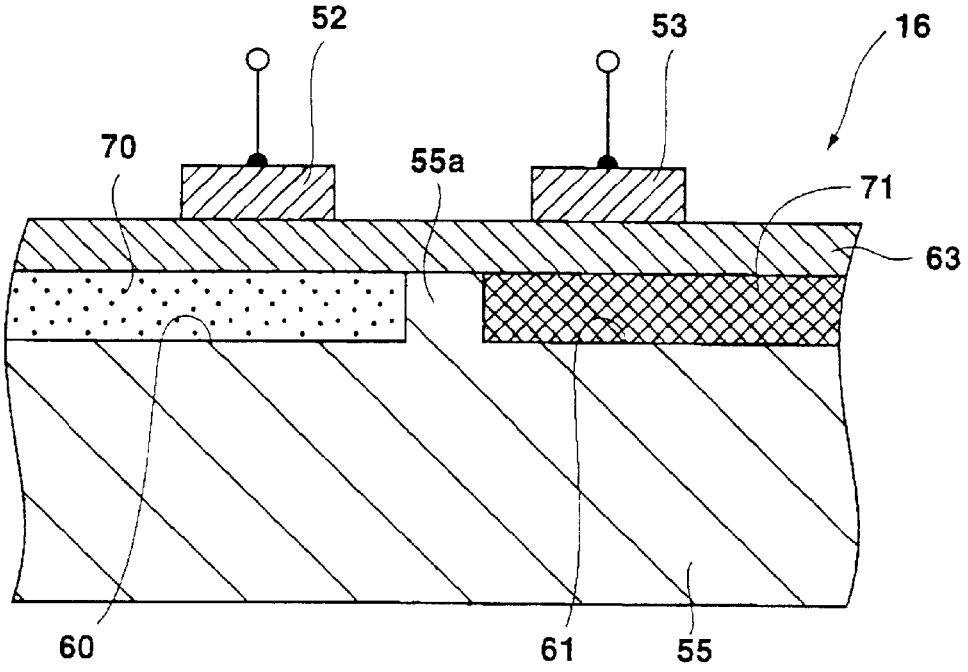
FIG. 12 is a sectional view of the printing head, taken along a line VI—VI of FIG. 11.

In FIG. 11 and FIG. 12, there is shown a structural example of a carrier jet type printing head. FIG. 13 shows a waveform chart of the printing operation.

In this printing head 16, a quantifying-sided nozzle 50 of ink 70 and a jetting-sided nozzle 51 of a dilution fluid 71 are provided on an orifice plate functioning as a base plate 55. These nozzles 50 and 51 are communicated with an ink conducting hole 54 and a dilution fluid conducting hole 56, respectively.

Furthermore, a quantifying-sided cavity (ink chamber) 60 and a jetting-sided cavity (dilution fluid chamber) 61 are provided behind these conducting holes 54 and 56. A vibration plate 63 is provided with these cavities. This vibration plate 63 is driven by a quantifying-sided piezoelectric element 52 and a jetting-sided piezoelectric element 53, respectively. Then, drive signals indicated in FIG. 13A and FIG. 13B are supplied to the quantifying-sided piezoelectric element 52 and the jetting-sided piezoelectric element 53.

That is, FIG. 13A shows an example of the drive signal supplied to the jetting-sided piezoelectric element 53. Large deviation is given to the piezoelectric element 53 at timing "a" of FIG. 13A, so that a dilution fluid 71 of the dilution fluid conducting hole 56 is jetted from the jetting-sided nozzle 51. At timing "b" and "c" of FIG. 13A, the piezoelectric element 53 is deformed (captured) along a direction opposite to that of the above-described deviation, and also the dilution fluid 71 is refilled into the dilution fluid conducting hole 56 from the jetting-sided cavity 61.

Figure 13B:
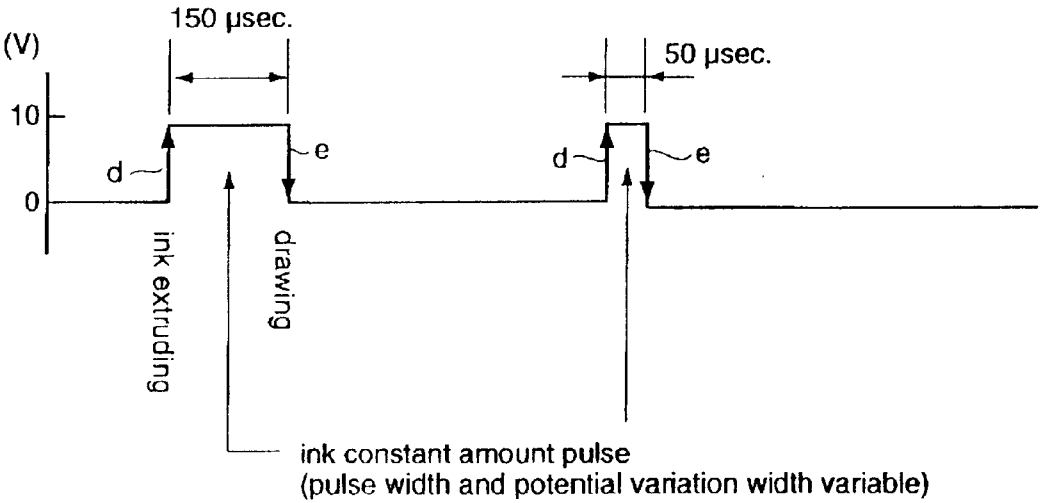

FIG. 13B represents an example of a drive signal supplied to the quantifying-sided piezoelectric element 52. During a time period from "d" to "e", the ink 70 is extruded from the quantifying-sided nozzle 50, and this extruded ink 70A is reserved in front of the quantifying-sided nozzle 51. Then, the dilution fluid 71 is jetted from this jetting-sided noise 51, so that the ink is mixed with this jetted dilution fluid 71 in accordance with a thickness (amount) of the reserved ink 70A.

In this printing head, the jetting timing (a) is selected to be, for instance, 1 millisecond interval. Then, for example, potential changes from 0V to 20V are applied to the jetting-sided piezoelectric element 53.

On the other hand, for example, potential changes from 0V to 10V are applied to the quantifying-sided piezoelectric element 52 at timing (d). In this case, the ink is not jetted under deviation of the piezoelectric element 52 by this potential changes, but the ink 70A is extruded from the tip portion of the nozzle 50, the amount of which depends upon the potential change width and the pulse widths "d" to "e".

In this case, the amount of the ink 70 extruded in response to the time period from "d" to "e" and the potential change width is controlled, so that the thickness of the ink 70A reserved in front of the jetting-sided nozzle 51 can be controlled. Furthermore, the dilution fluid 71 is jetted while being mixed with this ink 70A, so that the diluted ink droplets 57 are projected. The density of the ink droplets 57 may be arbitrarily controlled by the above-explained ink amount 70A.

In other words, both the time period from "d" to "e" and the potential change width are controlled in response to the print information to be, for example, 150$\mu$ seconds and 10V; 50$\mu$ seconds and 10V, so that the printing operation can be done in arbitrary intermediate gradation. In this case, 64 sets of intermediate gradation may be available, if conditions are satisfied.

However, in this case, for example, in the host computer 159 (see FIG. 10), the print information is formed in 8 bits=256 gradation. To the contrary, when the gradation (6 bits=64 gradation) of the intermediate gradation printed by the printer apparatus is smaller than 256 gradation, the gradation extending method such as a so-called "multi-gradation dither method" (as one example, multi-gradation error diffusion method) is employed. This multi-gradation dither method has already been described.

That is to say, for example, in the multi-gradation error diffusion method, as represented in FIG. 8A, a level of an arbitrary pixel "A" for constituting an image is replaced from an originally printed level X (256 gradation) into an actually printed level X' (normally, 4, 6, 8, 16, 32, 64 gradation, in this case, 64 gradation). In this case, the following methods are employed. That is, the level X' to be replaced is set to the level being nearest the level X. Alternatively absolute values of differences between plural levels realized by the level X' and the level X are replaced as probabilities. In the latter method, there are possibilities that the level X' is replaced by all of the realizable levels.

Moreover, an error portion "$\epsilon$" between the level X and the level X' is distributed to pixels around the pixel "A" so as to be added. As indicated in FIG. 8A, as to this distribution method, there are the following methods. In one distribution method, (7/16)$\epsilon$ is distributed to a pixel subsequent to the pixel A, (3/16)$\epsilon$ is distributed to a pixel before the next scanning line, (5/16)$\epsilon$ is distributed to a pixel just under the pixel A, and (1/16)$\epsilon$ is distributed to a pixel after the next scanning line. In another distribution method, the error portion is distributed only to an arbitrary one pixel at probability of the respective distribution rates.

It should be noted that the error portion $\epsilon$ owns codes of "±". The errors of the peripheral pixels to which the errors have been distributed are calculated as to the value, added with the distributed errors. Furthermore, when the value added with the distributed error exceeds a maximum printing level or a minimum printing level in a printable range, the value exceeding this maximum printing level or minimum level may be clipped. Otherwise, this exceeding portion is again distributed to the peripheral pixels in the above-described rate, or probability in a similar calculation manner to the above error portion "$\epsilon$".

In this manner, the error portion $\epsilon$ of the pixel A is distributed to the peripheral pixels, so that the printing error is distributed. This is carried out over the overall input image to thereby form image data to be printed. As a result, the gradation of the image which is obtained by printing out the print information can be essentially enlarged (for example, 64 gradation is enlarged into 256 gradation). The above-described distribution rate and numeral values are merely one example, and therefore may be varied in accordance with the differences of the gradation to be converted, and ranges (number) of pixels to which the error portions are distributed.

As a consequence, for instance, since the above-described dither method is employed in the host computer, the print information of 64 gradation which can be printed by the printer apparatuses can be formed from the print information of 256 gradation (=8 bits) formed in the host computer. Then, in this case, for example, the print information of 64 gradation is expressed by, for instance, 6 bits. In this dither method, the image data as shown in FIG. 7 and FIG. 8B are obtained.

Figure 14:
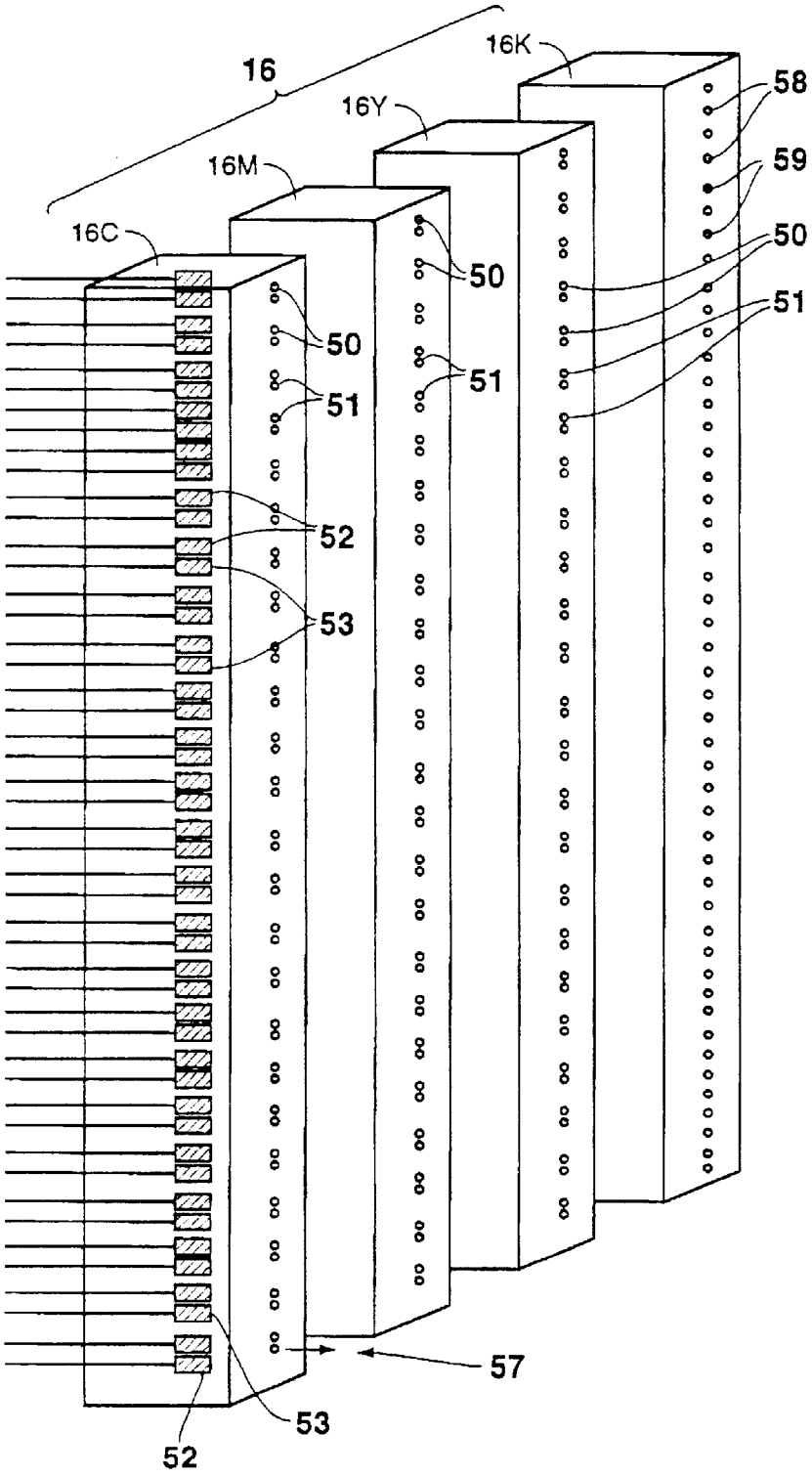
FIG. 14 is a perspective view for indicating a concrete example of the printer head.

FIG. 14 represents a concrete structure of the above-described printing head. That is, in FIG. 14, for example, printing heads 16C, 16M, 16Y, and 16K for 4 colors (cyan C, magenta M, yellow Y, black K) are provided. The nozzles 51, 52, 58, 59 are provided along the head longitudinal direction, which contain 24 pieces of piezoelectric elements 52 for cyan C, magenta M, yellow Y, and 48 or 64 pieces of piezoelectric elements 53 for black K (only piezoelectric element for cyan is indicated and other elements are omitted), which are printed out by a single scanning operation.

In this case, the nozzles 58 and 59 for black are provided along the head longitudinal direction. When a natural image is printed out, the nozzle 58 is used to jet the ink, whereas when a character is printed out, both of the nozzles 58 and 59 are jointly used to jet the ink. These nozzles 58 and 59 may be arranged as indicated by a two-dot/dash line in FIG. 11. These nozzles may be simply driven by two-value pulses to jet the ink. Otherwise, these nozzles may be driven by way of the above-explained carrier jet method (black density of control). When the nozzles 56 and 59 are jointly used, a partition wall 55*a* between both ink chambers may be omitted to communicate both of the ink chambers.

Then, in response to the above-described modulation signal and jetting signal, the piezoelectric elements 52 and 53 are driven, so that the ink droplets of density corresponding to the gradation of the print information are jetted. When the ink droplets are jetted, for instance, 24 pieces of ink droplets for cyan C, magenta M, Yellow Y are jetted at the same time, whereas 48 or 64 pieces of ink droplets for black K are jetted at the same time. These color ink droplets are jetted at preselected timing.

Furthermore, when these printing heads 16C, 16M, 16Y, 16K are driven, there are provided the D/A converting unit 13 through the printing head modulating unit 37, the drive units 15, 38, and the printing head jetting unit 36, whose numbers are equal tot he total number of nozzles with respect to each of these printing heads, in such a manner as shown in FIG. 9 or FIG. 10. It should be understood that when the printing head for the black 16K is driven by the 2-value pulse mode, another circuit arrangement shown in FIG. 17 may be employed.

Figure 15:
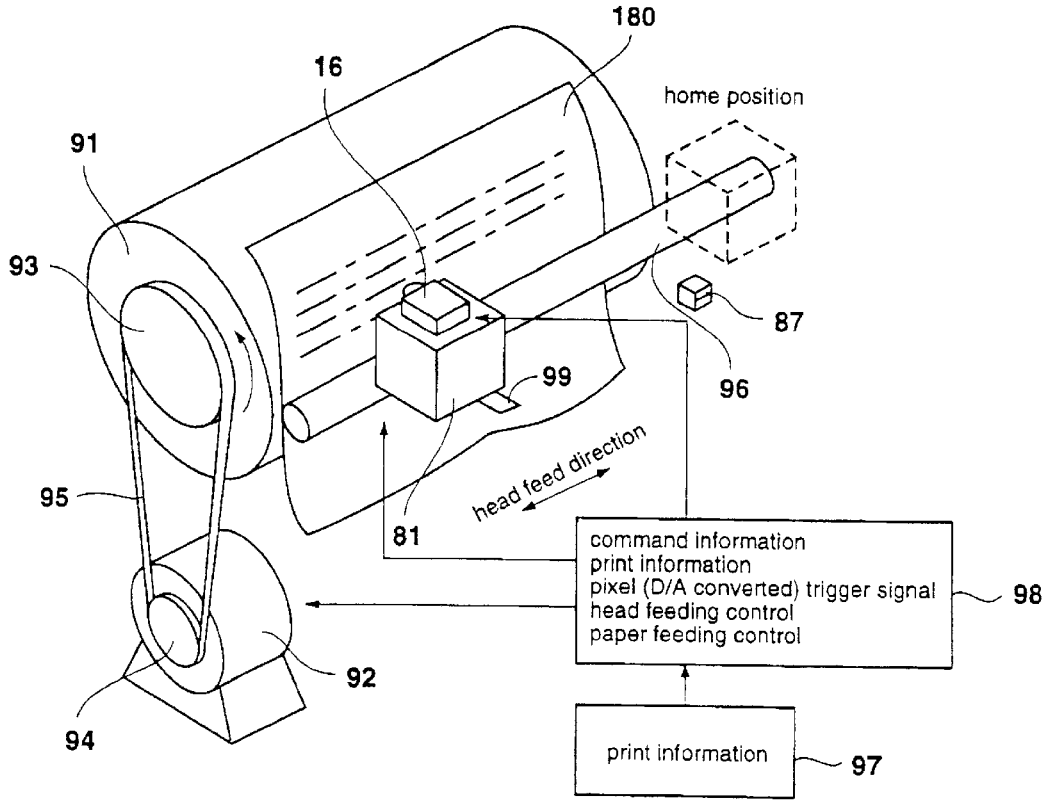
FIG. 15 is a perspective view for schematically indicating a serial type ink jet printer apparatus equipped with the printing head of FIG. 11.

FIG. 15 represents an example of a serial type printer apparatus into which the above-described printing head is assembled. According to this printer apparatus, a recording paper 180 is traveled while being wound on the circumferential surface of the platen 91. This platen 91 is rotated via pulleys 93 94 and a belt 95 by a paper feed motor 92 (a portion of motor 21 of FIG. 10).

Then, the printing head 16 containing the piezoelectric elements 52 and 53 is provided on the head carriage 81, and this head carriage 81 is mounted on a feed screw 96 provided in parallel to the circumference surface of the platen 91. This feed screw 96 is driven by a head feed motor (not shown), so that the printing head 16 mounted on the head carriage 81 is moved in parallel to the circumferential surface of the platen 91.

Then, for example, in accordance with the print information supplied from the host computer 150 (see FIG. 10), the print information and command information for transmission, the transmission signal such as a pixel trigger signal, and a control signal 98 for controlling the head feeding operation and the paper feeding operation are produced. Moreover, these transmission signals are transmitted to the head carriage 81, and the respective control signals are supplied to the head feed motor (not shown), and the paper feed motor 92. As a result, the printing operation is performed in response to the print information 97, the recording paper 180 is transported, and the printing head 16 is scanned.

Furthermore, in this apparatus, a tongue piece 99 is provided with the head carriage 81, and this tongue piece 99 is detected by a position detection sensor 87 provided in a travel path of the head carriage 81. As a result, when the normal scanning operation is not carried out, for example, a detection is made of such a fact that the head carriage 81 is returned to a home position indicated by a broken line.

Figure 16:
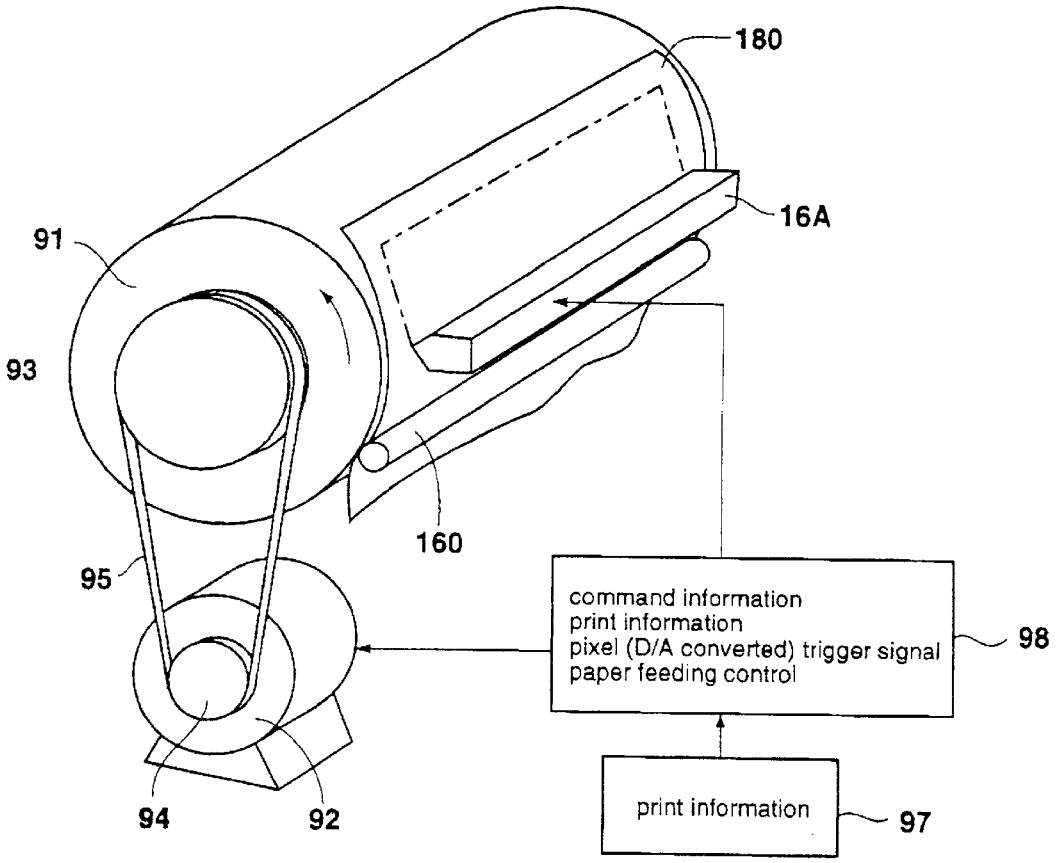
FIG. 16 is a perspective view for schematically showing a line type ink jet printer apparatus.

FIG. 16 illustrates an example of a line type printer apparatus. In this case, instead of the serial type printer head 16 and the feed screw 96 shown in FIG. 15, such a line head 16A that a large number of heads are arranged in a line manner is fixed along the shaft direction of the platen 91.

In this example, the line head 16A is constructed by arranging a large number of head assemblies (see FIG. 14) along the shaft direction of the platen. As a consequence, although a detailed structure of this line head 16A in this specification, the printing operations for 1 line are carried out at the same time by the circuits shown in FIG. 9 and FIG. 10. When the printing operations for 1 line are completed, the platen 91 is rotated by only 1 line to execute the next printing operations (note that reference numeral 160 of FIG. 16 indicates a paper pressure roller, and this paper pressure roller may be used in the printer of FIG. 15). In this case, other printing methods may be conceived, namely all of lines are printed out in a batch mode. Also, the entire line is subdivided into a plurality of blocks. Also, the printing operations are alternately carried out every 2 lines. Other methods are similarly realized, as explained with respect to FIG. 15.

FIG. 17 to FIG. 20 represent a printer apparatus according to another embodiment of the present invention.

Figure 17:
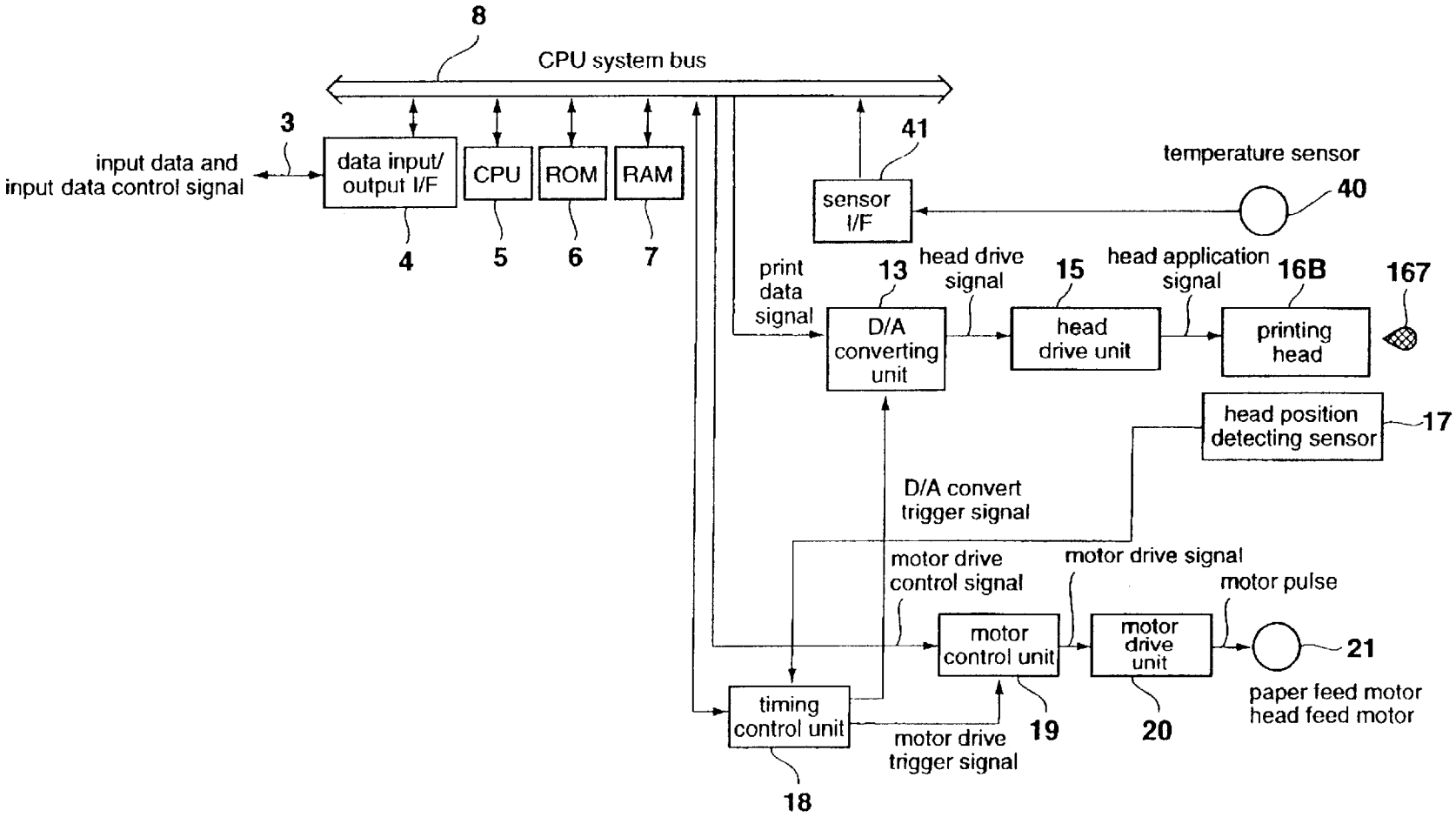
FIG. 17 is a schematic block diagram for showing a circuit used to drive another ink jet printer apparatus according to the present invention.
Figure 18:
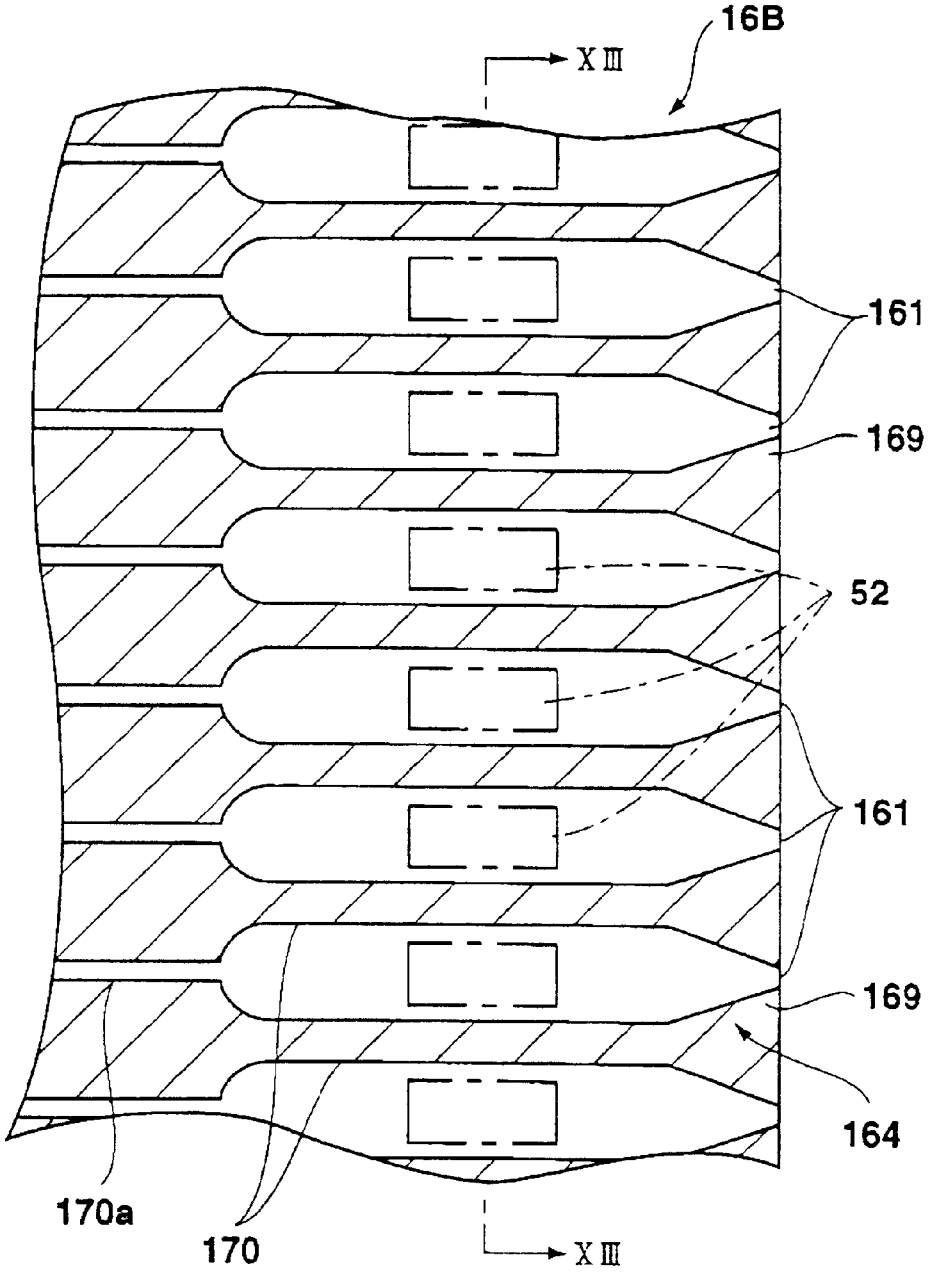
FIG. 18 is a sectional view for indicating a printing head employed in the ink jet printer apparatus of FIG. 17.

This embodiment is related to the normal type printer which is different from the carrier jet type printer. Referring now to FIG. 17 to FIG. 19, a structure of a printing head 16B will be explained. In this printing head, a piezoelectric element 52 functioning as an electrostrictive vibrator which may produce the electrostrictive phenomenon (namely, when electric field is applied to dielectric member, deformation and distortion will occur) is employed. Then, for instance, a desirable intermediate gradation print is available by way of a so-called "ink dot diameter modulating method". As will be discussed later, a change in ink droplet jetting characteristic can be corrected which is caused by a change in head temperatures and a change in peripheral environmental temperatures.

The above-described ink dot diameter modulating method implies the following method. That is, a level of a voltage applied to the piezoelectric element (electrostrictive vibrator) 52 of the printing head 16B is varied in accordance with image data to be printed out. While the piezoelectric element 52 is deviated in response to a change in this applied voltage level, volumes of ink droplets jetted from the nozzle 161 are varied in response to deviation of the piezoelectric element 52, so that a diameters of an ink dot is varied which is formed by adhering the ink droplets jetted from a nozzle 161 on the recording paper 180. As a consequence, a desirable intermediate gradation printing operation can be done.

As explained above, the printing head 16B using the ink dot diameter modulating method for quantifying the volumes of the jetted ink droplets is arranged by a plate type electrostrictive vibrator 52 made of piezoelectric ceramics deviated along a direction by an arrow SD in FIG. 19 in response to the applied voltage; a vibrating plate 63 adhered to this electrostrictive vibrator 52; a nozzle unit 164 equipped with these electrostrictive vibrator 52 and vibrating plate 63; an ink chamber 170 provided between the base plate 55 and the vibrating plate 63 inside the nozzle unit 164; an ink supply port 170*a* for supplying the ink 70 filled into the ink chamber 170; a nozzle 161/orifice unit 169 for jetting the ink 70 as ink droplets 167 (see FIG. 20); and a voltage generator (not shown) for generating the voltage applied to the electrostrictive vibrator 52.

Then, the voltage is generated from the voltage generator in response to the data of image to be printed out so as to be applied to the electrostrictive vibrator 52, so that the volume within the ink chamber 170 is varied to thereby jet the ink droplets 167.

Figure 20:
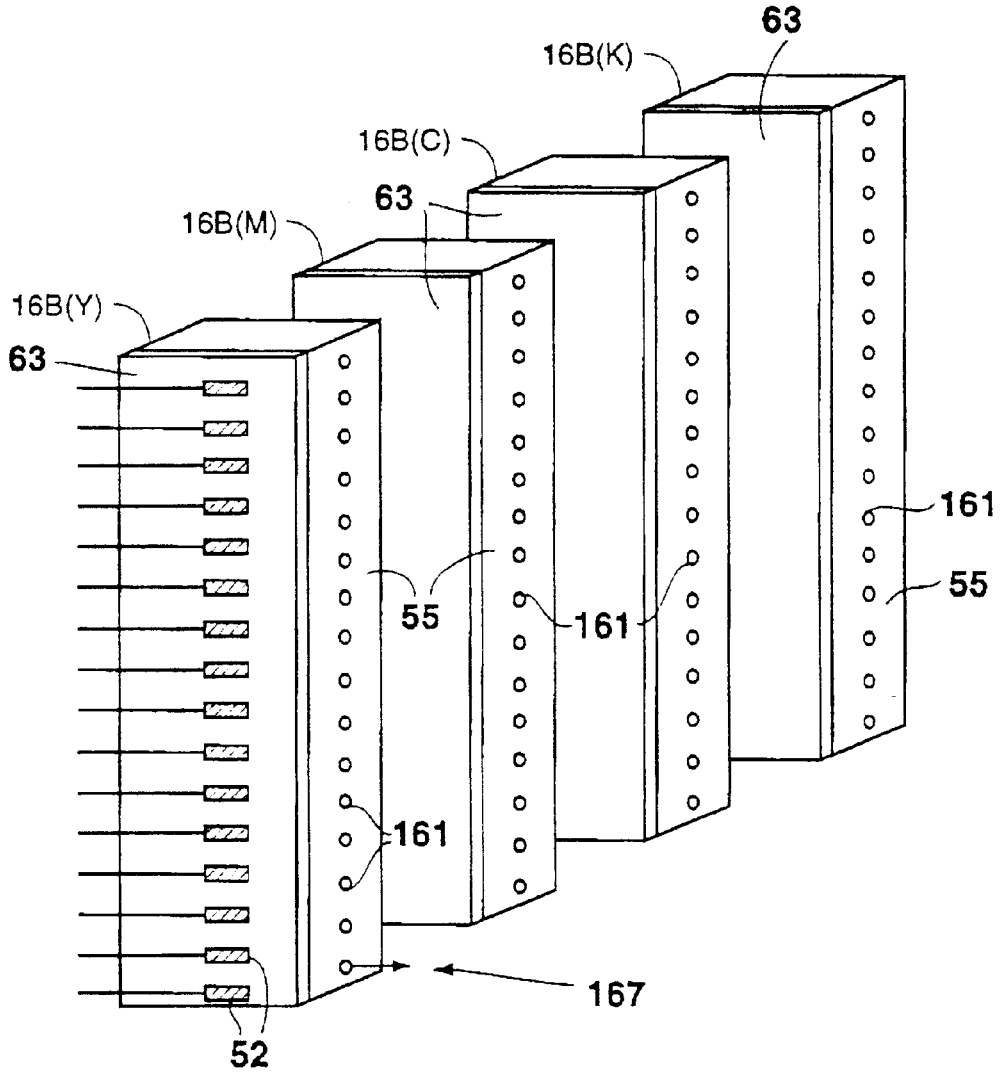
FIG. 20 is a perspective view for indicating a concrete example of the printing head of FIG. 19.

The printing head 16B is applied to such a printing head having multi-color/multi-nozzle (head for yellow 16B(Y), head for magenta 16B(M), head for cyan 16B(C) and head for black 16B(K)) as illustrated in FIG. 18 and FIG. 19. That is, as represented in FIG. 20, in the printing head 16B with this multi-nozzle structure, for instance, the electrostrictive vibrators 52 are provided in correspondence with a large number of nozzles. The ink droplets 167 are jetted from the respective nozzles 161 by applying the voltages to these electrostrictive vibrators 52.

Similar to the previously explained embodiment, as the material of the electrostrictive vibrator 52, there are piezoelectric ceramics, quartz, Rochelle salt and so on. The piezoelectric ceramics are made of barium titanate lead zirconate ($PbTiO_3.PbZrO_3$) and barium titanate ($BaTiO_3$). Also, the present invention may be properly applied not only to the printing head having the multi-color/multi-nozzle as indicated in FIG. 20, but also an ink jet printing head having a mono color/single nozzle, another ink jet printing head having a multi-color/single nozzle, and another ink jet printing head having a single color/multi-nozzle.

Furthermore, according to the printing head of this embodiment, it is possible to realize a sufficient gradation reproducibility when the diameter of the ink dot formed on the recording paper does not sufficiently respond to the change in the voltage level applied to the electrostrictive vibrator 52 (namely, when it is not possible to realize a sufficient gradation reproducibility by using only the ink dot diameter modulating method), the gradation reproduction ink dot arranging method correspond to the numbers of gradation realized by this ink dot diameter modulating method in addition to this ink dot diameter modulating method.

Concretely speaking, for instance, the ink dot diameter modulating method is employed within such a range that the stable gradation can be reproduced by the ink dot diameter modulating method. To the contrary, in such a range that the gradation is reproduced in unstable condition by employing the ink dot diameter modulating method, the gradation reproducing method by arranging the ink dots is utilized. In other words, as an example of such a case that the stable gradation reproduction cannot be realized, the ink dot arrangement gradation reproducing method is used in, for instance, a highlight portion of an image, whereas the original ink dot diameter modulating method is employed in an intermediate portion to a shadow portion of this image except for the highlight portion.

Alternatively, it is also possible to combine the ink dot diameter modulating method over the entire gradation, with the gradation reproducing method corresponding to the numbers of gradation achieved by this ink dot diameter modulating method. As this gradation reproducing method, there are, for instance, the random dither method and the systematic dither method corresponding to the independent determining method, and further the minimum average error method, the error diffusion method, the average value limiting method, and the dynamic threshold value method, which correspond to the conditioning determining method.

On the other hand, in the above-described printing head having the multi-nozzle structure, the jetting characteristics of the ink droplets are varied due to the temperature change of the printing head, and the changes in the peripheral environment/temperature. As a result, the resultant resolution is essentially lowered, as compared with the originally designed resolution, and also the printing gradation level becomes inaccurate, so that the printing operation with uniform image quality cannot be performed. Moreover, there are fluctuations in the jetting characteristics of the ink droplets from the respective nozzles due to the temperature changes.

As a result, according to this embodiment, a temperature sensor 40 such as a thermistor (see FIG. 17) is mounted near the orifice portion 169 of the printing head 16B. The temperature change of the printing head 16B, and also the peripheral environment temperature change are detected by this temperature sensor. Based on the detected temperature change, the content of the image data to be printed out is varied in such a manner that the temperature change gives the influence to the jetting characteristic of the printing head so as to cancel the adverse influences given to the ink dot diameters on the recording paper. As described above, according to this embodiment, since the content of the original image data is changed based on the detected value of the temperature change, it is possible to reproduce the printed image with the intermediate gradation (half tone) which could not be adversely influenced by the temperature change and the environment temperature change of the printing head under use.

It should be noted that the half tone printing operation not easily influenced by the temperature changes may be carried out not only when both the temperature change of the printing head and the peripheral environment temperature change are detected, but also when the only one temperature change detection is performed, while varying the content of the image data based on this detected value.

Referring now to FIG. 17, a structure and an operation of a printer apparatus according to this embodiment will be described. It should be understood that this structure and operation of the printer apparatus own the following different points from the printer apparatus shown in FIG. 9. That is, this printer apparatus is not the carrier jet type, and is not equipped with the dilution fluid jetting unit and the drive unit thereof, but only ink having precontrolled density is jetted. Since other structures of this printer apparatus are similar to those of the other printer apparatus, explanations thereof are omitted.

Similar to those of FIG. 9, the print data signal derived from the RAM 7 is converted into a head drive signal having a voltage level actually used in the printing operation by the D/A converting unit 13. This head drive signal is sent to a head drive unit 15.

In this head drive unit 15, the head drive signal is amplified in such a manner that the amplified power thereof can deviate the electrostrictive vibrator of the printing head 16B. Then, this amplified signal is supplied as the head drive signal to the electrostrictive vibrator of the printing head 16B.

In the printing head 16B, the electrostrictive vibrator 52 shown in FIG. 19 is deviated along a direction indicated by an arrow SD in response to the voltage level of the head printing signal, so that the vibrating plate 63 is depressed to be bent. As a consequence, the volume in the ink chamber 170 is decreased, and then the ink 70 filled in this ink chamber 170 is depressed, so that this depressed ink is jetted via the nozzle 161 from the orifice portion 169, and thus is projected as an ink droplet 167 onto the recording paper.

The ink droplet 167 may form an ink dot having a certain size on the recording paper. This ink dot owns such a size corresponding to the voltage level applied to the electrostrictive vibrator 52.

While the present invention has been described with reference to the embodiments, the present invention is not limited thereto, but may be modified based upon the technical spirit and scope of the present invention.

For instance, various sorts of image data which are used to form the character region and the image region may be employed, and the method for outputting these image data and the timing thereof are not limited to the above-explained methods and timing. Also, as to the data about the dots to which no ink is jetted, the timing and the quantities thereof may be varied. The dither method is not limited to the above-described dither methods.

In the above-described embodiment, the printer apparatus is arranged as a "so-called carrier jet type" for quantifying the ink and for jetting the dilution fluid. Instead of this carrier jet type, this printer apparatus may be constructed of other ink jet types capable of quantifying the dilution fluid to thereby jet the ink, resulting in a similar effect. In the later printing apparatus, there is a merit that the sufficient ink density can be achieved in the shadow portion. Alternatively, the ink of black (K) is not mixed with the dilution fluid, but may be solely jetted.

The above-described printer apparatus is suitable to record the image on the recording paper. However, since the half tone printing operation is not always required when only characters are printed. Thus, the above-described ink jetting operation may be carried out under 2-value control.

It should be also noted that the above-described ink and dilution fluid may be arbitrarily selected from these fluids known in the art. Also, the printer apparatus of the present invention may perform the full color recording operation as using three colors of magenta, yellow, cyan (further block may be added), and furthermore may execute the monochromatic recording operation and the black/white recording operation.

Other than the energy capable of making the recording material as the fluid droplets by way of the electrostrictive vibrator, there are the resistor heating method (see FIGS. 3A through 3D), and the heating beam irradiation method such as laser light. To increase the heating efficiency, conductive materials may be added to the recording materials. Alternatively, the heating member may be combined with the laser as the heating method. In this case, even when the power of the respective heating means is lowered, the recording operation may be carried out under better condition.

Also, the structure and the shape of the printing head are not limited to those of the above-described embodiments, but may be freely selected, and the materials of the respective portions for constituting the printing head may be selected from the known materials.

As the ink jet printers to which the present invention can be applied, there are the below-mentioned types of printers:

(I). On-demand type ink jet printers; and (II). Continuous type ink jet printers (in view of method sort).

(1). Two-value printers, and (2). Half-tone (intermediate gradation) printers (in view of function).

(a). Dot diameter modulating printers, and (b). Density modulating printers involving a so-called "two-fluid mixing type carrier jet type printer (in view of half-tone imaging printers).

As previously described in detail, according to the present invention, when the recording operation is carried out by using a large number of dots based on the recording data, in such a region that any of the plural dots are sequentially formed having density higher than a preselected density value, only the dots other than a specific dot are recorded. Accordingly, when a single pixel is forme, this recording material is adhered on a recorded member such as a recording paper, and immediately after, no recording operation is performed as a specific dot position. As a consequence, even when the recording material on the recorded member is fixed and subsequently, another recording material is adhered onto another position adjacent to the first-mentioned position (otherwise, same position) to thereby form the next pixel, these recording materials of not mutually interfere with each other.

Therefore, such a problem that the recording materials on the recorded member are spread and mixed with each other can be suppressed to minimum values. Thus, the color reproduction characteristic can be increased to achieve high image qualities, and also to increase resolution.

The above-described particular effects can be achieved even under the following cases, namely when no print-dedicated paper is used a the recorded member, when the environmental temperatures during the printing operations are lowered, and when the printing head is scanned in high speeds. As a consequence, the low-cost recording paper can be used, resulting in low-cost operation and easy operation.

Further, as previously explained, since the recording method and the recording apparatus according to the present invention are executed in the below-mentioned manner, the following effects can be mainly achieved. In the character region, the recording data corresponding to a preselected character is outputted, whereas no recording data is outputted to the non-character portion which constitutes the background thereof. In the image region, the recording data corresponding to the printed image in the half tone is outputted so as to print out a predetermined main image printing portion and the background thereof.

(1). Since none of recording data is outputted to the portions other than the character within the character region (concretely speaking, none of ink droplet is jetted), the resulting contrast between the character portion and other background portions becomes maximum. Also, since there is no ink in the portions other than the character, it is possible to avoid such a problem that the ink fluids are spread. Moreover, since the transparent fluid component (dilution fluid) is not jetted at the unnecessary portion (namely, portion except for character), the total amount of the consumed transparent fluid can be minimized, so that the printing cost can be reduced.

(2). In the image region, it is required to achieve the better gradation reproducibility in the printed image. The suitable method is applied to the main image printing portion and the background thereof.

As previously described, in the recording method and the recording apparatus of the present invention, since the character region is discriminated from the image region, the optimum character printing method and also the optimum image printing method can be employed in the respective regions, so that the image qualities in the respective regions can be improved. In particular, these inventive recording method/apparatus may constitute the effective means when the above-explained two-fluid mixing type printing method is executed.

What is claimed is:

1. A recording method for adhering ink droplets, corresponding to recording data, on a recording member in a dot form so as to record the recording data thereon, the method comprising the steps of:

forming a plurality of recording dots having a density higher than or equal to at least a preselected density in a region of said recording member;

providing a plurality of specific dots at a predetermined interval; and jetting said ink droplets on said recording member corresponding to a plurality of dots other than said plurality of specific dots and not jetting ink droplets on said recording member at the predetermined interval corresponding to said plurality of specific dots.

2. A recording method as claimed in claim 1 further comprising the step of:

providing said preselected density as a minimum density so that the ink droplets adhered onto said recording member start to spread, and adjoining ink droplets mix together.

3. A recording method as claimed in claim 1 wherein the step of:

forming said plurality of recording dots provides a recorded image, said recorded image having a continuous expansion with density higher than or equal to a predetermined density.

4. A recording method as claimed in claim 1 wherein the step of forming said plurality of recording dots is via a multi-gradation dither method.

5. A recording method as claimed in claim 1 further comprising the step of:

distributing said recording data corresponding to each of the plurality of said specific dots to said plurality of dots.

6. A recording method as claimed in claim 1 further comprising the step of:

employing a mixture fluid made by mixing quantified ink with an ink dilution fluid as said ink droplets.

7. A recording apparatus for jetting ink droplets corresponding to recording data from a recording head and for adhering the jetted ink droplets onto a recording member in a dot form so as to record the recording data thereon, the recording apparatus comprising:

a data input unit for producing the recording data in a region where a plurality of recording dots having a density higher than or equal to at least a preselected density are formed;

a signal converting unit for converting said recording data into a recording head drive signal, the signal converting unit connected to the data input unit; and a drive unit for driving said recording head by modulating the recording head in response to said head drive signal, the drive unit connected to the signal converting unit;

wherein, the recording head jets said ink droplets corresponding to a plurality of dots other than a plurality of specific dots and stops jetting said ink droplets corresponding to the plurality of specific dots existing at a predetermined interval, based on said recording head drive signal.

8. A recording apparatus as claimed in claim 7 wherein:

said preselected density is a minimum density in which ink droplets adhered onto said recording member starts to spread, and the adjoining ink droplets start to mix together.

9. A recording apparatus as claimed in claim 7 wherein:

a recorded image formed by said plurality of recording dots owns a continuous expansion with density higher than, or equal to a predetermined density.

10. A recording apparatus as claimed in claim 7 wherein:

said plurality of recording dots are formed by a multi-gradation dither method.

11. A recording apparatus as claimed in claim 7 wherein:

said recording data corresponding to said a specific dot of plurality of specific dots is distributed to said other dots.

12. A recording apparatus as claimed in claim 7 further comprising:

a mixture fluid made by mixing quantified ink with an ink dilution fluid is employed as said ink droplets.

* * * * *